US008540443B2

(12) United States Patent
Okuno

(10) Patent No.: US 8,540,443 B2
(45) Date of Patent: Sep. 24, 2013

(54) PRINTER AND PRINTING METHOD WHICH PREVENTS A DECURLING UNIT FROM DETERIORATING A PRINT QUALITY

(75) Inventor: Ryoji Okuno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/896,589

(22) Filed: Oct. 1, 2010

(65) Prior Publication Data

US 2011/0081189 A1 Apr. 7, 2011

(30) Foreign Application Priority Data

Oct. 5, 2009 (JP) ..... 2009-231451

(51) Int. Cl.
*B41J 15/00* (2006.01)
*B41J 2/315* (2006.01)
*B41J 35/16* (2006.01)

(52) U.S. Cl.
USPC ..... 400/619; 400/120.03; 400/621; 347/174

(58) Field of Classification Search
USPC ..... 400/619, 621, 120.04, 120.02, 120.03; 347/174, 175, 176, 177, 178; 399/406
See application file for complete search history.

(56) References Cited

U.S. PATENT DOCUMENTS

| | | | | |
|---|---|---|---|---|
| 4,496,824 | A * | 1/1985 | Kawai et al. | 347/223 |
| 5,042,375 | A * | 8/1991 | Gruner et al. | 101/93.01 |
| 5,743,663 | A * | 4/1998 | Imai | 400/120.04 |
| 6,249,301 | B1 * | 6/2001 | Kawamura et al. | 347/218 |

FOREIGN PATENT DOCUMENTS

| | | | |
|---|---|---|---|
| JP | H06-286921 | A | 10/1994 |
| JP | 2001002295 | * | 1/2001 |
| JP | 3190489 | B2 | 7/2001 |
| JP | 2002-104688 | A | 4/2002 |
| WO | 2008/114703 | A2 | 9/2008 |
| WO | 2008114703 | A2 | 9/2008 |

* cited by examiner

*Primary Examiner* — Daniel J Colilla
*Assistant Examiner* — Blake A Tankersley
(74) *Attorney, Agent, or Firm* — Canon USA Inc. IP Division

(57) ABSTRACT

A printer is provided that includes a conveyance unit configured to nip and simultaneously convey the roll recording medium; a print unit configured to print an image by sequentially transferring a plurality of color inks on the recording medium while nipping the recording medium conveyed by the conveyance unit; a decurling unit disposed between the conveyance unit and the print unit, and configured to include a raised portion that decurls the recording medium by contacting the recording medium conveyed by the conveyance unit; and a control unit configured to control the conveyance unit to convey the recording medium to a waiting position after ending the transfer of one color ink, wherein the waiting position is a position where an area on a leading edge side of the recording medium is in contact with the raised portion.

7 Claims, 24 Drawing Sheets

PRINTER AND PRINTING METHOD WHICH PREVENTS A DECURLING UNIT FROM DETERIORATING A PRINT QUALITY

BACKGROUND OF THE INVENTION

1. Field of the Invention

The present invention relates to a printer and a printing method that decurl a recording medium.

2. Description of the Related Art

A printer that prints data onto a roll recording medium includes a decurling mechanism that decurls a recording medium. The decurling mechanism decurls the recording medium to inversely curl the recording medium by moving and pressing a raised member to the recording medium or pressing the recording medium to the raised member.

However, when the raised member keeps in contact with the same portion of the recording medium for a longtime, a crease is produced at the portion. Since there is a high possibility that ink does not normally adhere to the portion of the crease production, a problem of deterioration in print quality can arise. Japanese Patent Publication No. 3190489 discusses an apparatus that solves the problem. A decurling apparatus discussed in Japanese Patent Publication No. 3190489 includes a mechanism driven with power of a roller that conveys a recording sheet. When the roller rotates in the winding direction of the recording sheet, the mechanism has a decurling function, and when the roller rotates (inversely rotates) in the rewinding direction of the recording sheet, the mechanism moves to a specific position, thereby cancelling the decurling.

Japanese Patent Application Laid-Open No. 2002-104688 discusses a recording apparatus having a function of preventing the aging deformation of a recording sheet. It is assumed that printing is performed in the recording apparatus while the recording sheet passes through space between a grip roller having a large number of projections on the surface thereof and a pinch roller. Before the printing, a contact portion of the recording medium with the grip roller changes as predetermined time passes.

In printing on a roll recording medium with a dye-sublimation printer as a thermal transfer printer, heat generated by a thermal head is advantageous to decurl the recording medium. In this case, as the number of print colors (number of inks) increases, the heating time of the recording medium is prolonged. Therefore, by actively pressing the portion heated by the thermal head to the raised member, excessive decurling can produce a crease at the portion. If the crease is made in a print area (area in which a large part of an image is printed) on the recording medium, a problem of deterioration in print quality can occur.

The problems can be solved by additionally installing the mechanism discussed in Japanese Patent Publication No. 3190489 in the printer because the mechanism has a function of cancelling the decurling. However, to add the mechanism, the installing space of the mechanism needs to be secured, and the size of printer therefore increases and product costs rise. Since it is assumed that the recording apparatus discussed in Japanese Patent Application Laid-Open No. 2002-104688 records data on an unroll recording medium, the problems are not solved only by periodically changing the contact position between the recording medium and the grip roller.

SUMMARY OF THE INVENTION

The present invention is directed to provide a printer and a printing method that prevent the deterioration in print quality without adding a mechanism in a case of printing in which a plurality of inks thermally adheres to a roll recording medium with heat.

According to the present invention, all the problems or at least one is solved.

According to an aspect of the present invention, a printer that divides a roll recording medium in a length direction to set one printing target range, includes a conveyance unit configured to nip and simultaneously convey the roll recording medium, a print unit configured to print an image by sequentially transferring a plurality of color inks on the recording medium while nipping the recording medium conveyed by the conveyance unit, a decurling unit disposed between the conveyance unit and the print unit, and configured to include a raised portion that decurls the recording medium by contacting the recording medium conveyed by the conveyance unit, and a control unit configured to control the conveyance unit to convey the recording medium to a waiting position after ending the transfer of one color ink. The waiting position is a position where an area on the leading edge side of the recording medium is in contact with the raised portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
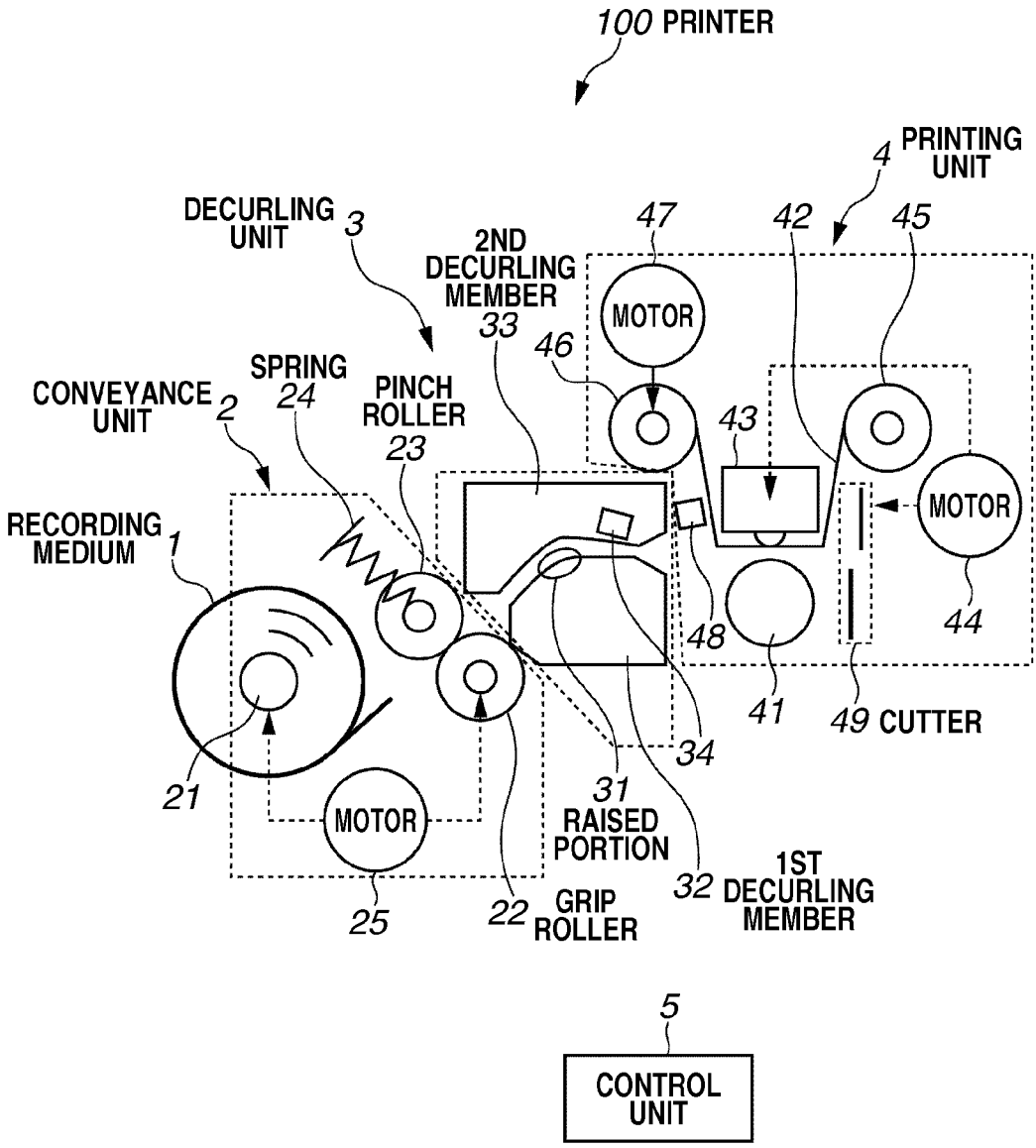
FIG. 1 illustrates a configuration of a printer according to a first exemplary embodiment of the present invention.

FIG. 1 illustrates a configuration of a printer according to a first exemplary embodiment. Referring to FIG. 1, a printer 100 according to the first exemplary embodiment has one printing target range by separating a roll recording medium 1 in the length direction, and includes: conveyance unit 2; decurling unit 3; print unit 4; and control unit 5. In the printer 100, the control unit 5 controls operation of the conveyance unit 2 and the print unit 4, thereby printing the data in the printing target range of the recording medium 1 that has passed through the decurling unit 3. Hereinbelow, a description is given of a specific configuration of the conveyance unit 2, the decurling unit 3, the print unit 4, and the control unit 5.

In the conveyance unit 2, the recording medium 1 is wound like a roll to a core portion 21 (refer to FIG. 1). Near the core portion 21, a grip roller 22 and a pinch roller 23 are arranged. The grip roller 22 has a plurality of projections on the surface thereof, and the pinch roller 23 is pressed to the grip roller 22 by a spring 24. In the conveyance unit 2, a motor 25 rotates under the control of the control unit 5, thereby transmitting power generated by the rotation to the core portion 21 and the grip roller 22 via power transmission unit (not illustrated). As a consequence, the recording medium 1 wound to the core portion 21 is wound out, thereby passing through the space between the grip roller 22 and the pinch roller 23. The recording medium 1 is rewound to the core portion 21 by inversely rotating the motor 25.

The recording medium 1 passing through the space between the grip roller 22 and the pinch roller 23 is fed to the decurling unit 3 adjacent to the conveyance unit 2. The decurling unit 3 includes: a first decurling member 32; a second decurling member 33 disposed facing the first decurling member 32; and a recording medium detection sensor 34 disposed in the second decurling member 33. A raised portion 31 is set to the first decurling member 32. A conveyance passage at the raised portion 31 is curving in the inverse direction of the curling of the recording medium. The conveyance passage that curls the recording medium 1 in the inverse direction of the curling is formed to a space between a surface provided with the raised portion 31 in the first decurling member 32 and the second decurling member 33.

In the decurling unit 3, when the recording medium 1 passes through the conveyance passage, the recording medium 1 comes into contact with the raised portion 31. Thus, the winding the recording medium 1 to the core portion 21 results in curling the recording medium 1 that curls inward in the inverse direction (outward), thereby decurling the recording medium 1. In the decurling unit 3, the second decurling member 33 is disposed, thereby preventing the recording medium 1 from completely separating from the raised portion 31. More specifically, the recording medium 1 is decurled without continuously applying specific power or elastic load to the recording medium 1. The recording medium detection sensor 34 detects whether the leading edge of the recording medium 1 passes through the exit side of the conveyance passage.

The recording medium 1 passing through the decurling unit 3 is fed to the print unit 4 adjacent to the decurling unit 3. The print unit 4 includes a platen roller 41 that supports the recording medium 1. The platen roller 41 does not have drive force, and is rotatably supported to a shaft (not illustrated). At a position facing the platen roller 41, a thermal head 43 is disposed to individually attach a plurality of inks coated on an ink ribbon 42 to the recording medium 1 with heat. The thermal head 43 is movable up and down between a print position and a retreating position driven by power of the motor 44 and power transmission unit (not illustrated) that transmits the power to the thermal head 43. At the print position, the thermal head 43 can attach the ink to the recording medium 1. At the retreating position, the thermal head 43 is apart from the platen roller 41. As illustrated in FIG. 1, the ink ribbon 42 is in contact with an under portion of the thermal head 43, and is movable from a bobbin 45 on the supply side to a bobbin 46 on the winding side. Specifically, the ink ribbon 42 wound to the bobbin 45 on the supply side is wound to the bobbin 46 on the winding side via the under portion of the thermal head 43 with power of a motor 47 and power transmission unit (not illustrated) that transmits the power to the bobbin 46 on the winding side. The ink ribbon 42 is coated with a plurality of inks including yellow (Y) color, magenta (M) color, cyan (C) color, overcoat (OC), and a black stripe marker for determining the ink position. A ribbon marker sensor 48 that detects the black stripe marker is disposed between the thermal head 43 and the bobbin 46 on the winding side.

Near the platen roller 41 and the thermal head 43, a cutter 49 is disposed to cut the recording medium 1. The cutter 49 cuts the recording medium 1 with the power of the motor 44 and power transmission unit (not illustrated) that transmits the power to the cutter 49.

Figure 2:
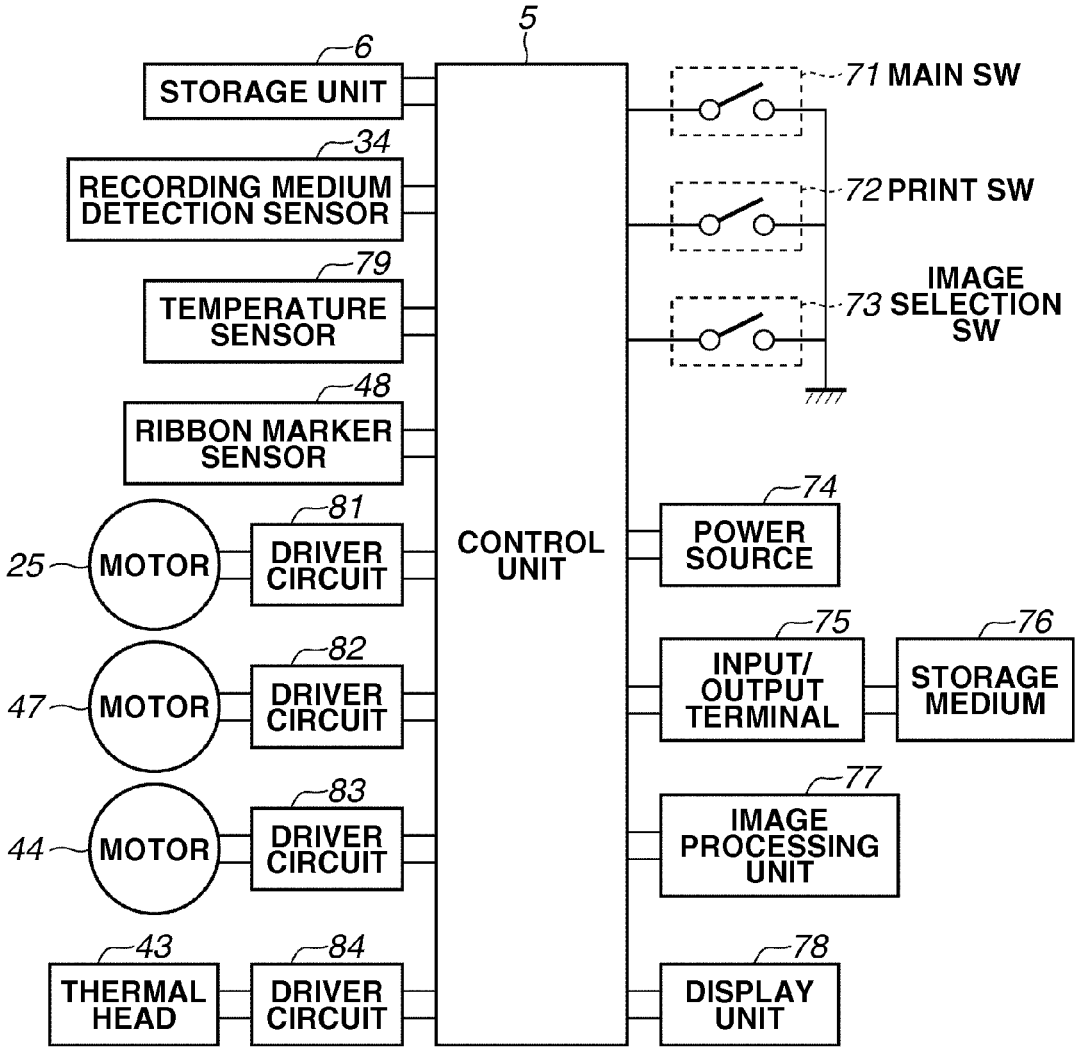
FIG. 2 is a block diagram illustrating components connected to control unit in the printer according to the first exemplary embodiment.

FIG. 2 is a block diagram illustrating components connected to the control unit 5 in the printer 100. A main switch 71, a print switch 72, and an image selection switch 73 operate the printer 100. An input/output terminal 75 is used for reading image information stored in a storage medium 76 as a nonvolatile recording medium, e.g., secure digital (SD) card. Image processing unit 77 performs image processing under the control of the control unit 5. Display unit 78 is, e.g., a liquid crystal display (LCD), and displays data under the control of the control unit 5. A temperature sensor 79 detects the temperature of the thermal head 43. Driver circuits 81, 82, and 83 individually control the operation of the motors 25, 47, and 44. A driver circuit 84 controls heating operation of the thermal head 43.

Storage unit 6 stores control information indicating operation contents of the conveyance unit 2 and the print unit 4 corresponding to each of inks coated on the ink ribbon 42. The control information indicates the conveyance amount of the recording medium 1 and the history of print contents.

Next, the operation of the printer 100 is described.

Figure 3:
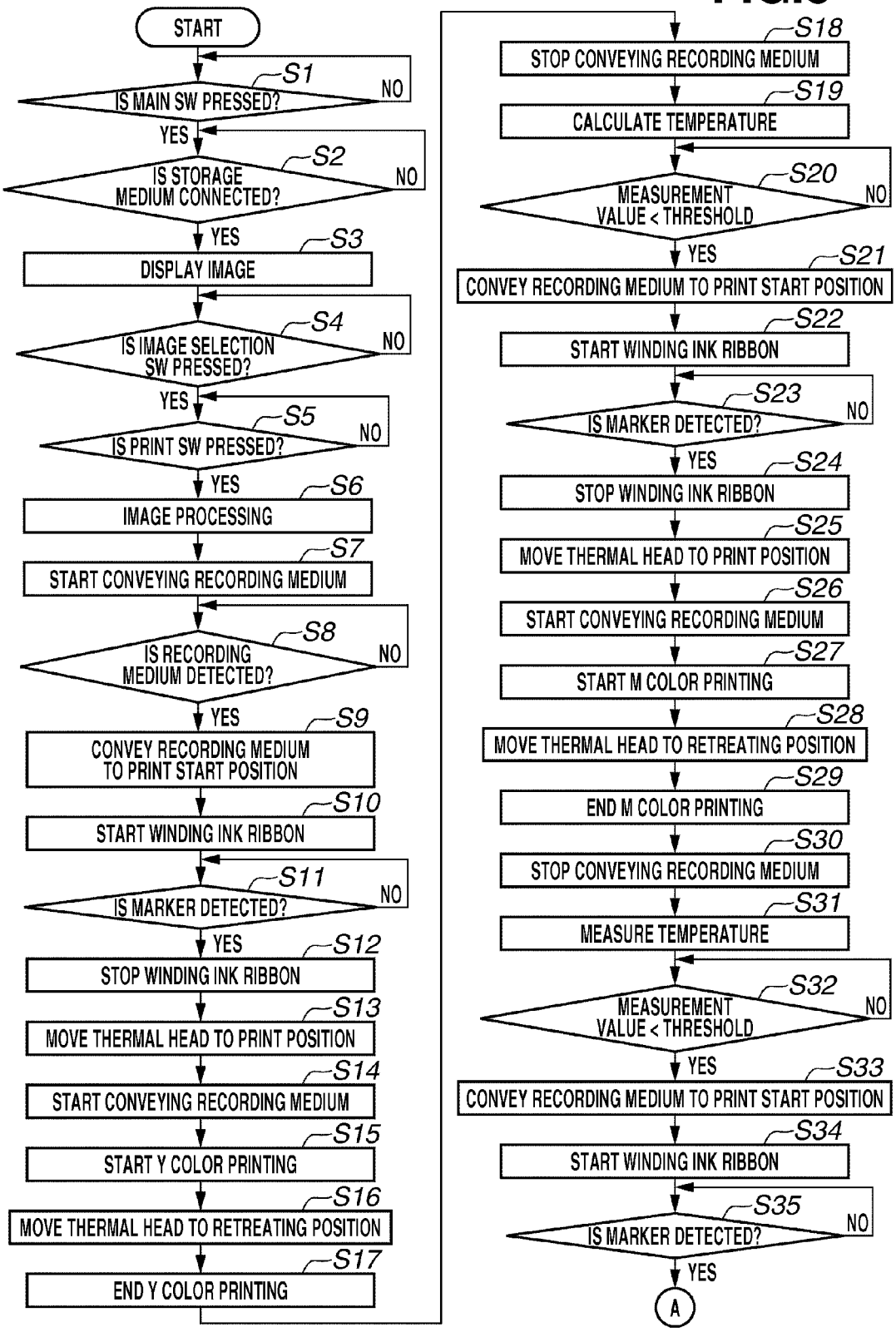
FIG. 3 is a flowchart illustrating an operating procedure of the printer according to the first exemplary embodiment.
Figure 4:
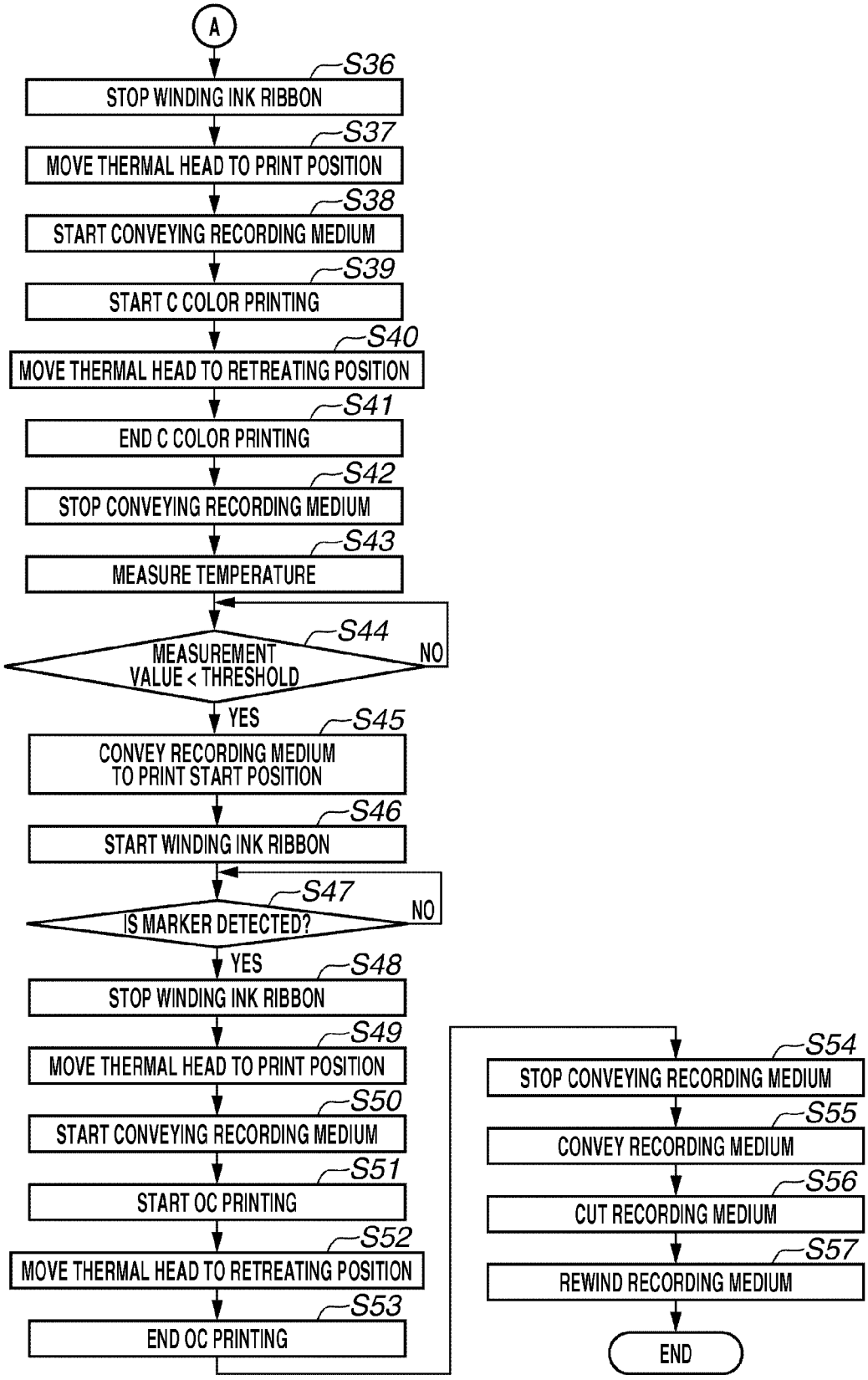
FIG. 4 is a flowchart illustrating another operating procedure of the printer according to the first exemplary embodiment.

FIGS. 3 and 4 are flowcharts illustrating operating procedures of the printer 100. The control unit 5 is operable with power supplied form a power source.

In step S1, the main switch 71 is pressed. In step S2, the control unit 5 detects whether the storage medium 76 is connected to the input/output terminal 75. When the storage medium 76 is connected to the input/output terminal 75 (Yes in step S2) and the storage medium 76 stores the image information, the control unit 5 reads the image information. In step S3, the control unit 5 controls the image processing unit 77 to convert the read image information into image information suitable to display, and thereafter controls the display unit 78 to display the image. A user of the printer 100 selects an image to be printed from the images displayed on the display unit 78 by operating the image selection switch 73. In step S4, the control unit 5 checks that the image selection switch 73 is pressed. Then, the printer 100 enters a print standby mode.

FIGS. 5A to 5D illustrate conveyance states of the recording medium 1 in Y color printing operation according to the first exemplary embodiment.

Figure 5A:
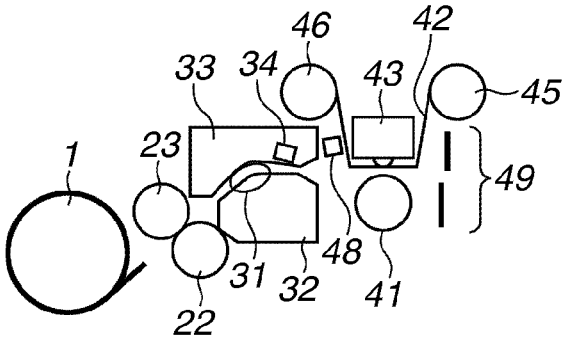
FIGS. 5A to 5D illustrate conveyance states of a recording medium in Y color printing operation according to the first exemplary embodiment.
Figure 5B:
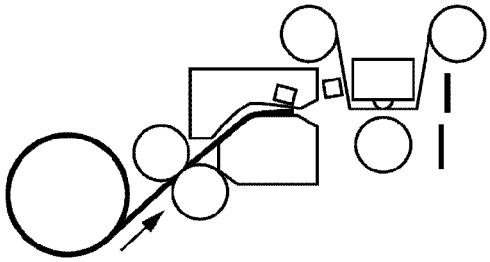
Figure 5C:
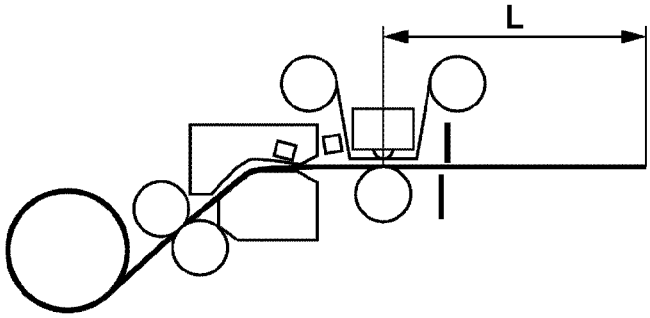

Referring to FIG. 5A, in step S5, the user presses the print switch 72 when the printer 100 is in the print standby mode. In step S6, the control unit 5 controls the image processing unit 77 to convert the image selected by the user into printable image information. When the processing ends, in step S7, the control unit 5 rotates the motor 25, thereby conveying the recording medium 1 to the decurling unit 3. Referring to 5A, when the printer 100 is in the print standby mode, the thermal head 43 is at the retreating position and the cutter 49 is opened at a passage position of the recording medium 1. In step S7, the control unit 5 conveys the recording medium 1 nipped between the grip roller 22 and the pinch roller 23 to the decurling unit 3, as illustrated in FIG. 5B.

In step S8, the recording medium detection sensor 34 detects the leading edge of the recording medium 1 conveyed to the decurling unit 3. The recording medium detection sensor 34 then outputs a detection signal indicating the detection to the control unit 5. In step S9, the control unit 5 reads an amount of the control information stored in the storage unit 6 when inputting the detection signal, and conveys the recording medium 1 to the print start position. According to the first exemplary embodiment, referring to FIG. 5C, the print start position is located where a length from the leading edge of the recording medium 1 to the platen roller 41 is L. The recording medium 1 is conveyed to the print start position, and the control unit 5 stops the rotation of the motor 25.

Figure 5D:
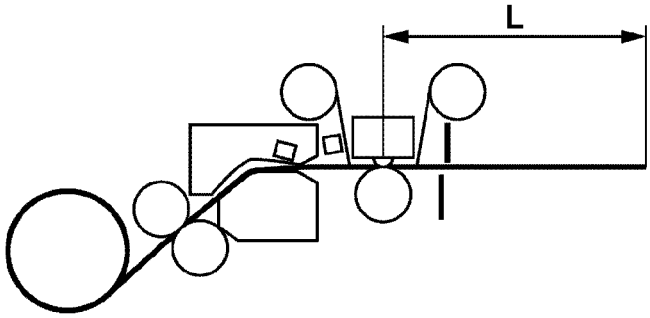

In step S10, the control unit 5 rotates the motor 47, thereby starting to wind the ink ribbon 42 from the bobbin 45 on the supply side to the bobbin 46 on the winding side. In step S11, the ribbon marker sensor 48 detects the black stripe ribbon marker coated on the ink ribbon 42. The ribbon marker sensor 48 outputs a detection signal indicating the detection to the control unit 5. In step S12, the control unit 5 stops the rotation of the motor 47 in response to an input of the detection signal, thereby stopping the winding of the ink ribbon 42. In step S13, the control unit 5 rotates the motor 44, thereby moving the thermal head 43 from the retreating position to the print position as illustrated in FIG. 5D.

The thermal head 43 moves to the print position. In step S14, the control unit 5 inversely rotates the motor 25 based on the control information, thereby starting to convey the recording medium 1 toward the decurling unit 3. In step S15, the control unit 5 performs control to heat the thermal head 43 via the driver circuit 84, and rotates the motor 47, thereby starting the Y color printing operation. According to the first exemplary embodiment, the Y color printing operation starts at the position apart the length L from the leading edge of the recording medium 1, i.e., at the print start position, and steps S14 and S15 are actually simultaneously executed. In the Y color printing operation, the recording medium 1 is rewound together with the ink ribbon 42, nipped between the thermal head 43 and the platen roller 41. At this time, the thermal head 43 is heated while winding the ink ribbon 42 from the bobbin 45 on the supply side to the bobbin 46 on the winding side, thereby attaching the Y color ink coated on the ink ribbon 42 to the recording medium 1.

When the attaching of the Y color ink to the recording medium 1 ends, in step S16, the control unit 5 inversely rotates the motor 44 to prevent unnecessary heating of the ink ribbon 42, thereby moving the thermal head 43 from the print position to the retreating position. In step S17, the Y color printing operation ends. When the control unit 5 receives a detection signal indicating that the leading edge of the recording medium 1 passes through the outlet side of the conveyance passage disposed in the decurling unit 3, from the recording medium detection sensor 34, the control unit 5 conveys the recording medium 1 with a predetermined conveyance amount, thereby stopping the rotation of the motor 25. In step S18, the control unit 5 stops the conveyance of the recording medium 1.

When the conveyance of the recording medium 1 stops, in step S19, the control unit 5 measures temperature of the thermal head 43 based on a detection value of the temperature sensor 79. In step S20, the control unit 5 checks whether the measurement value is lower than a predetermined threshold. Until the measurement value becomes lower than the threshold, the recording medium 1 is in a standby mode. When the measurement value becomes lower than the threshold, the control unit 5 executes the M color printing operation.

FIGS. 6A to 6D illustrate conveyance states of the recording medium 1 in M color printing operation.

Figure 6A:
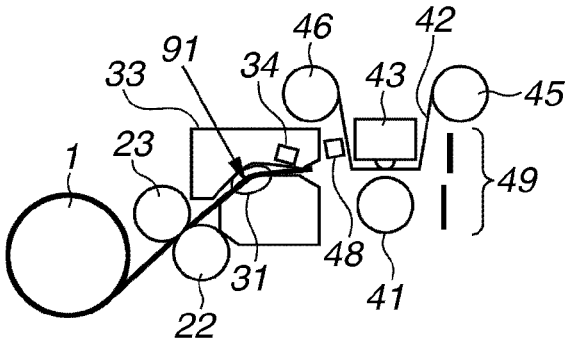
FIGS. 6A to 6D illustrate conveyance states of the recording medium in M color printing operation according to the first exemplary embodiment.
Figure 6B:
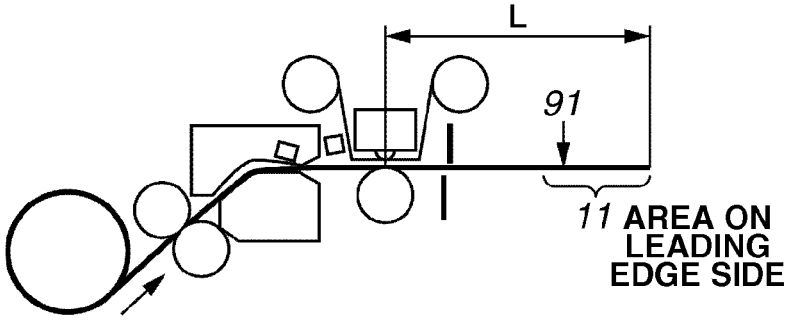
Figure 6C:
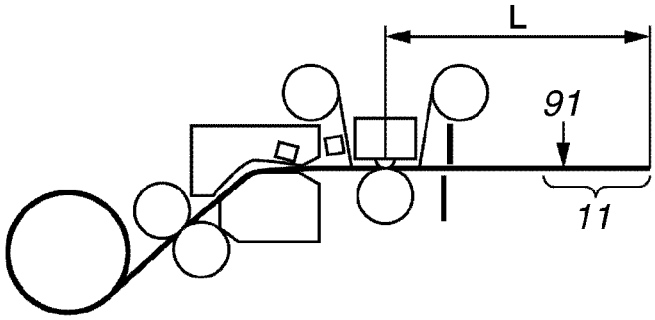
Figure 6D:
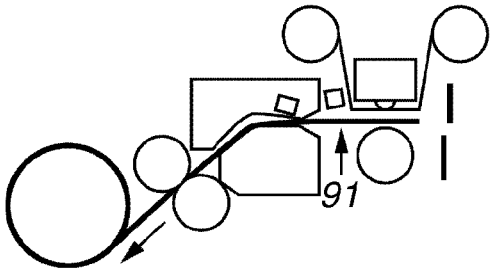

After ending the Y color printing operation, the recording medium 1 is in the standby mode in contact with the raised portion 31 at a waiting position 91 set in an area 11 on the leading edge side within the printing target range (refer to FIGS. 6A and 6B). When the recording medium 1 is in the standby mode as illustrated in FIG. 6A, if the measurement value of the control unit 5 becomes lower than the threshold, the control unit 5 executes steps S21 to S30 as the M color printing operation. The operation in steps S21 to S30 is similar to that in steps S9 to S18. More specifically, after conveying the recording medium 1 to the same print start position as that in the Y color printing operation, the recording medium 1 is returned toward the decurling unit 3 and the M color ink is attached to the recording medium 1 (refer to FIGS. 6B to 6D). In step S30, the contact position of the recording medium 1 with the raised portion 31 at the stop time of conveyance is set nearer to the leading edge than the waiting position 91 in the M color printing operation. In other words, the conveyance amount of the recording medium 1 in step S30 is larger than that in step S18.

When the conveyance of the recording medium 1 stops, in step S31, the control unit 5 measures the temperature of the thermal head 43 from the detection value of the temperature sensor 79. In step S32, the control unit 5 checks whether the measurement value is lower than a predetermined threshold. Until the measurement value becomes lower than the threshold, the recording medium 1 is in the standby mode. When the measurement value becomes lower than the threshold, the control unit 5 executes the C color printing operation.

FIGS. 7A to 7D illustrate conveyance states of the recording medium 1 in the C color printing operation.

Figure 7A:
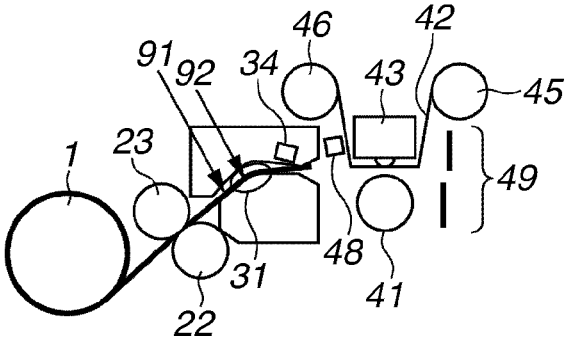
FIGS. 7A to 7D illustrate conveyance states of the recording medium in C color printing operation according to the first exemplary embodiment.
Figure 7B:
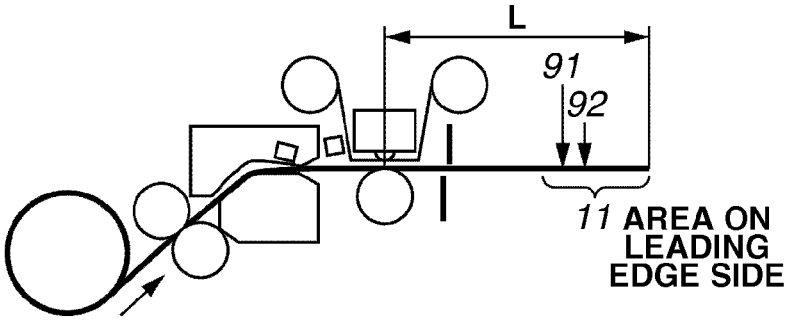
Figure 7C:
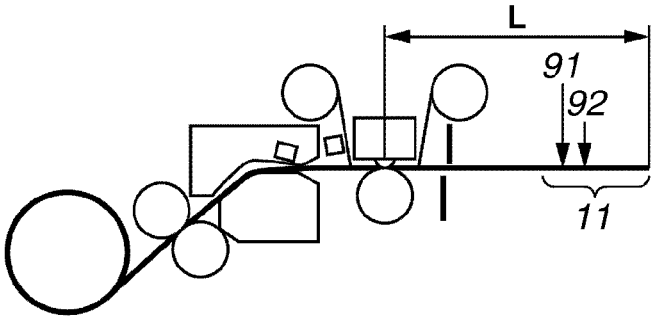
Figure 7D:
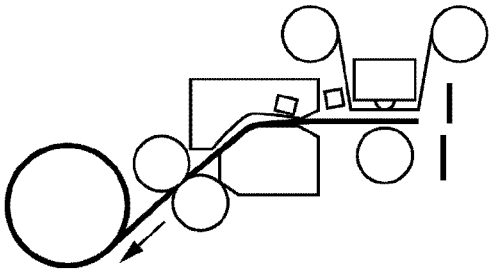

After ending the M color printing operation, the recording medium 1 is in the standby mode in contact with the raised portion 31 at a waiting position 92 nearer to the leading edge than the waiting position 91, within the area 11 on the leading edge side (refer to FIG. 7A). The waiting position 92 is nearer to the leading edge of the recording medium 1 than the waiting position 91, and the leading edge of the recording medium 1 thus floats up. Thus, the decurling effect of the waiting position 92 is smaller than that of the waiting position 91. When the measurement value of the control unit 5 becomes lower than the threshold while the recording medium 1 is in the standby mode as illustrated in FIG. 7A, the control unit 5 executes the operation in steps S33 to S42. The operation in steps S33 to S42 is similar to that in steps S9 to S18. In other words, after conveying the recording medium 1 to the same print start position as those of the Y color printing operation and M color printing operation, the C color ink is attached to the recording medium 1 by returning the recording medium 1 toward the decurling unit 3 (refer to FIGS. 7B to 7D). A flowchart subsequent to step S36 is illustrated in FIG. 4.

In the C color printing operation, the waiting position 92 of the recording medium 1 after the M color printing operation is different from the waiting position 91 after the Y color printing operation. In step S33, the control unit 5 thus adjusts the print start position of the C color printing operation to be similar to those in the Y color printing operation and the M color printing operation based on the control information. In step S42, the contact position of the recording medium 1 with the raised portion 31 at the stop time of conveyance is set to the position nearer to the leading edge of the recording medium 1 than the waiting position 92 in the C color printing operation. More specifically, the conveyance amount of the recording medium 1 in step S42 is larger than that in step S30.

When the conveyance of the recording medium 1 stops, in step S43, the control unit 5 measures the temperature of the thermal head 43 from the detection value of the temperature sensor 79. In step S44, the control unit 5 checks whether the measurement value is lower than a predetermined threshold. Until the measurement value becomes lower than the threshold, the recording medium 1 is in the standby mode. When the measurement value becomes lower than the threshold, the control unit 5 executes the OC printing operation.

FIGS. 8A to 8D illustrate conveyance states of the recording medium 1 in the OC printing operation.

Figure 8A:
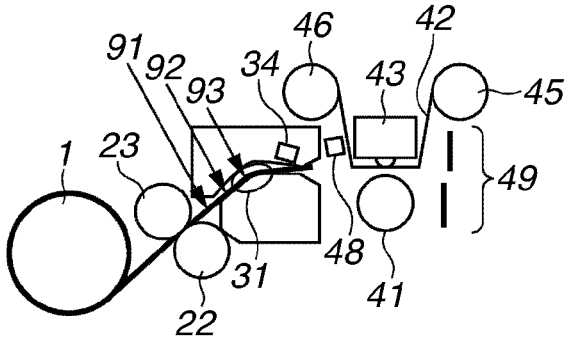
FIGS. 8A to 8D illustrate conveyance states of the recording medium in OC color printing operation according to the first exemplary embodiment.
Figure 8B:
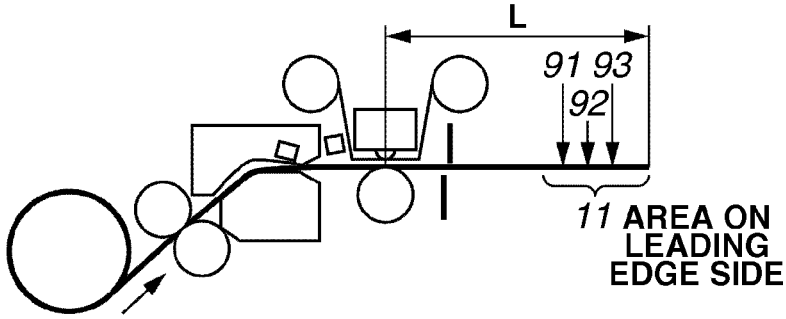
Figure 8C:
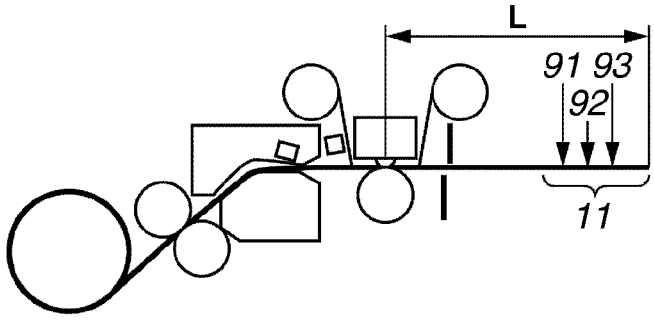
Figure 8D:
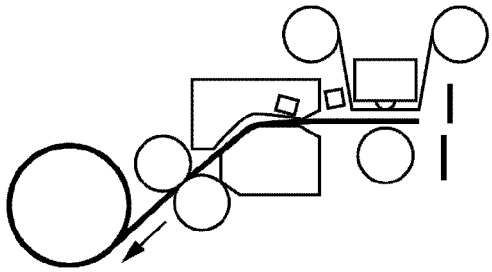

After ending the operation of the C color printing operation, the recording medium 1 is in the standby mode in contact with the raised portion 31 at a waiting position 93 nearer to the leading edge of the recording medium 1 than the waiting position 92, within the area 11 on the leading edge side (refer to FIG. 8A). Since the waiting position 93 is nearer to the leading edge of the recording medium 1 than the waiting position 92, the leading edge of the recording medium 1 floats up. As a consequence, the decurling effect of the waiting position 93 is smaller than that of the waiting position 92. When the measurement value of the control unit 5 becomes lower than the threshold while the recording medium 1 is in the standby mode as illustrated in FIG. 8A, the control unit 5 executes the operation in steps S45 to S54. The operation in steps S45 to S54 is similar to that in steps S9 to S18. More specifically, after conveying the recording medium 1 to the same print start position as those in the Y color printing operation, the M color printing operation, and the C color printing operation, the control unit 5 attaches the OC ink to the recording medium 1 while returning the recording medium 1 toward the decurling unit 3 (refer to FIGS. 8B to 8D).

In the OC printing operation, the waiting position 93 of the recording medium 1 after the C color printing operation is different from the waiting position 92. In step S45, the control unit 5 thus adjusts the print start position of the OC printing operation to be similar to those in each color operation based on the control information. In step S54, the control unit 5 stops the conveyance of the recording medium 1 at the position where the recording medium 1 is not in contact with the raised portion 31 based on the control information in the OC printing operation. Consequently, after ending the OC printing operation, the recording medium 1 is in the standby mode at the position without the decurling effect. After ending the OC printing operation, the control unit 5 executes the cutting operation.

Figure 9A:
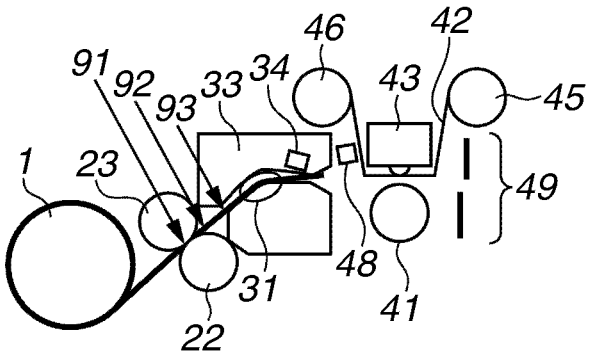
FIGS. 9A to 9C illustrate conveyance states of the recording medium in cutting operation according to the first exemplary embodiment.
Figure 9B:
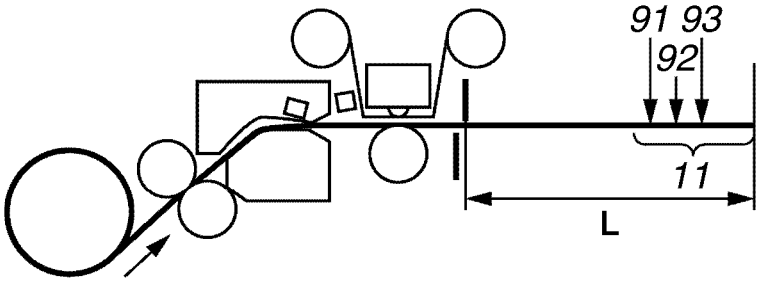
Figure 9C:
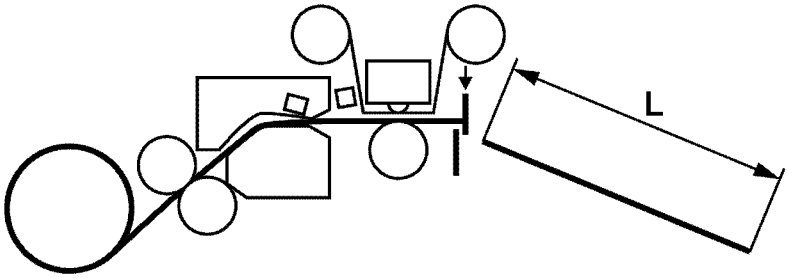

FIGS. 9A to 9C illustrate conveyance states of the recording medium 1 in the cutting operation according to the first exemplary embodiment.

After ending the OC printing operation, the recording medium 1 is in the standby mode in noncontact with the raised portion 31 (refer to FIG. 9A). In step S55, the control unit 5 rotates the motor 25 based on the control information, thereby conveying the recording medium 1 so that a length from the leading edge of the recording medium 1 to the cutter 49 becomes L as illustrated in FIG. 9B. In step S56, the control unit 5 rotates the motor 44, thereby causing the cutter 49 to cut the recording medium 1. In step S57, the control unit 5 inversely rotates the motor 25, thereby rewinding the recording medium 1 with the core portion 21 and the grip roller 22. Then, the cutting operation ends.

According to the first exemplary embodiment, the recording medium 1 is in the standby mode at the decurling unit 3 each time the printing of one color ends. The waiting positions 91, 92, and 93 are set within the area 11 on the leading edge side which has relatively small influence on the print quality in the printing target range. Thus, the deterioration in print quality is prevented without adding a new mechanism such as a mechanism for resetting the decurling.

According to the first exemplary embodiment, the waiting positions 91, 92, and 93 are differently set within the area 11 on the leading edge side, thereby preventing the concentration of the decurling of the raised portion 31 at the same position in the area 11 on the leading edge side. As a consequence, the crease is more certainly prevented in the area 11 on the leading edge side. Further, the waiting positions are set nearer to the leading edge of the printing target range as the ink is attached later according to the first exemplary embodiment. Accordingly, the higher the decurling effect, the smaller the number of print colors, and the lower the decurling effect, the larger the number of print colors. Thus, even if the heating time of the recording medium is prolonged together with the increase in print colors, the creation of crease is suppressed.

According to the present exemplary embodiment, the decurling unit 3 is provided between the thermal head 43 and the grip roller 22. The recording medium 1 is tensioned by the grip roller 22 conveying the recording medium 1 while nipping the recording medium 1 between the thermal head 43 and the platen roller 41, so that the recording medium 1 is efficiently decurled. However, the leading edge of the recording medium 1 passes through the decurling unit 3 without nipping the recording medium 1 between the thermal head 43 and the platen roller 41, and is not easily decurled as compared with another portion. The recording medium 1 is therefore in the standby mode so that the leading edge thereof is set within the decurling unit 3, so that the recording medium 1 is uniformly decurled.

According to the above-described exemplary embodiment, after ending the printing with each color, the recording medium is conveyed to the waiting position. However, if the measurement value of the temperature of the thermal head is lower than a predetermined threshold, the printing with the next color immediately starts without conveyance to the waiting position and the recording medium may be thus conveyed to the print start position.

(Modification)

A printer is described according to a modification of the first exemplary embodiment. A configuration of the printer is similar to that of the printer 100. The operation of the printer in steps S1 to S54 is similar to that of the printer 100. In other words, the cutting operation is different from the first exemplary embodiment.

Figure 10:
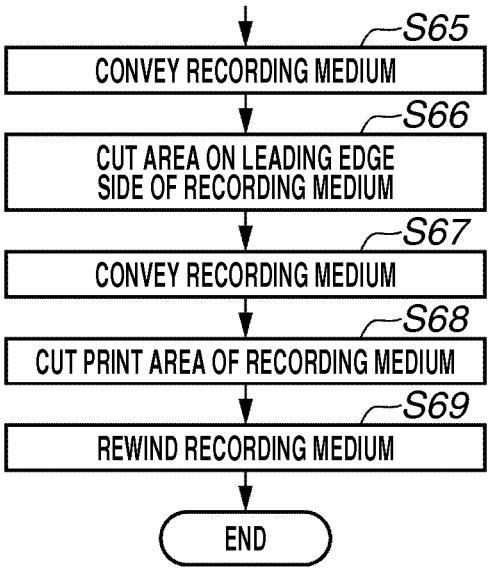
FIG. 10 is a flowchart illustrating a procedure of cutting operation according to a modification of the first exemplary embodiment.

FIG. 10 is a flowchart illustrating the cutting operation of the printer according to the modification of the first exemplary embodiment. FIGS. 11A to 11E illustrate conveyance states of the recording medium 1 in the cutting operation according to the modification of the first exemplary embodiment.

Figure 11A:
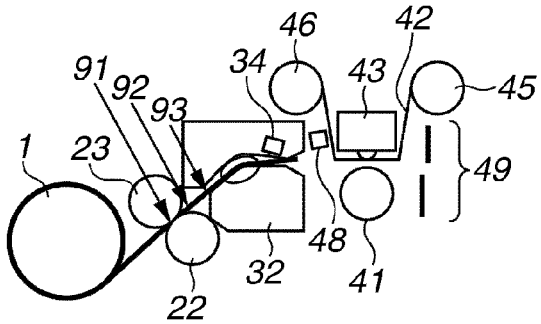
FIGS. 11A to 11E illustrate conveyance states of the recording medium in the cutting operation according to the modification of the first exemplary embodiment.
Figure 11B:
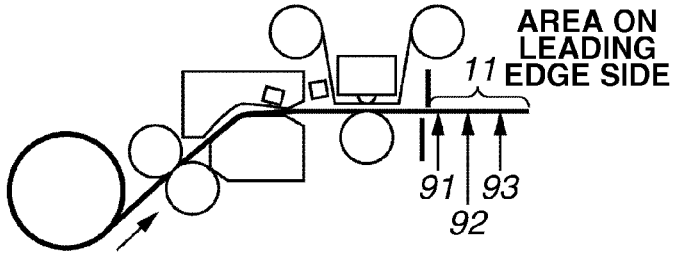
Figure 11C:
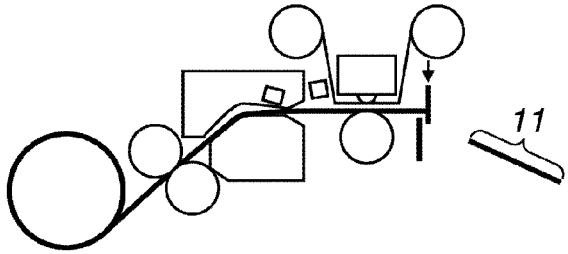
Figure 11D:
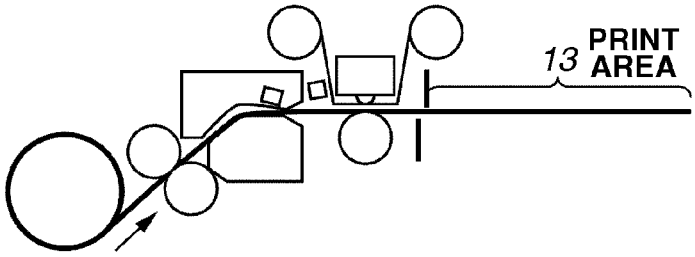
Figure 11E:
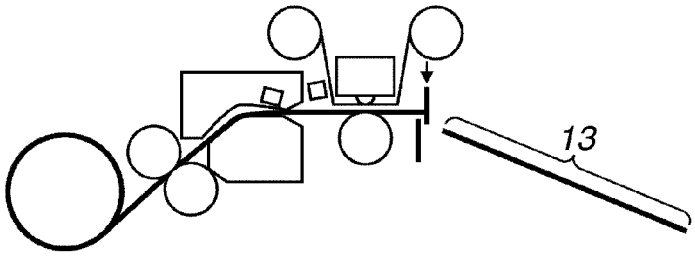

After the OC printing operation, the recording medium 1 is in the standby mode in noncontact with the raised portion 31 (refer to FIG. 11A). In step S65, the control unit 5 controls the conveyance of the recording medium 1 so that a length from the leading edge of the recording medium 1 to the cutter 49 becomes λ1 based on the control information. Only the area 11 on the leading edge side of the recording medium 1 thus passes through the cutter 49 (refer to FIG. 11B). In step S66, the control unit 5 rotates the motor 44, thereby causing the cutter 49 to cut the recording medium 1. As a consequence, the area 11 on the leading edge side is cut (refer to FIG. 11C). In step S67, the control unit 5 conveys the recording medium 1 to the position where the recording medium 1 passes through the cutter 49 with a length (L-λ1). The portion which passes through the cutter 49 in step S67 is a print area 13 adjacent to the area 11 on the leading edge side, on which a large part of the image is printed (refer to FIG. 11D). Since the print area 13 is not in contact with the raised portion 31 in the standby mode, the print area 13 is not influenced so much and little deterioration in print quality due to the decurling occurs. In step S68, the control unit 5 rotates the motor 44 after step S67, thereby causing the cutter 49 to cut the recording medium 1. As a consequence, the print area 13 is cut (refer to FIG. 11E). In step S69, the control unit 5 inversely rotates the motor 25, thereby rewinding the recording medium 1 with the core portion 21 and the grip roller 22. Thus, the cutting operation ends.

Since the area 11 on the leading edge side in which the print quality may deteriorate, is cut from the print area 13 according to modification of the first exemplary embodiment, only a portion showing no deterioration in print quality is printed out.

A configuration of a printer according to a second exemplary embodiment is similar to that of the printer 100 according to the first exemplary embodiment. The operation of the printer is described below.

Figure 12:
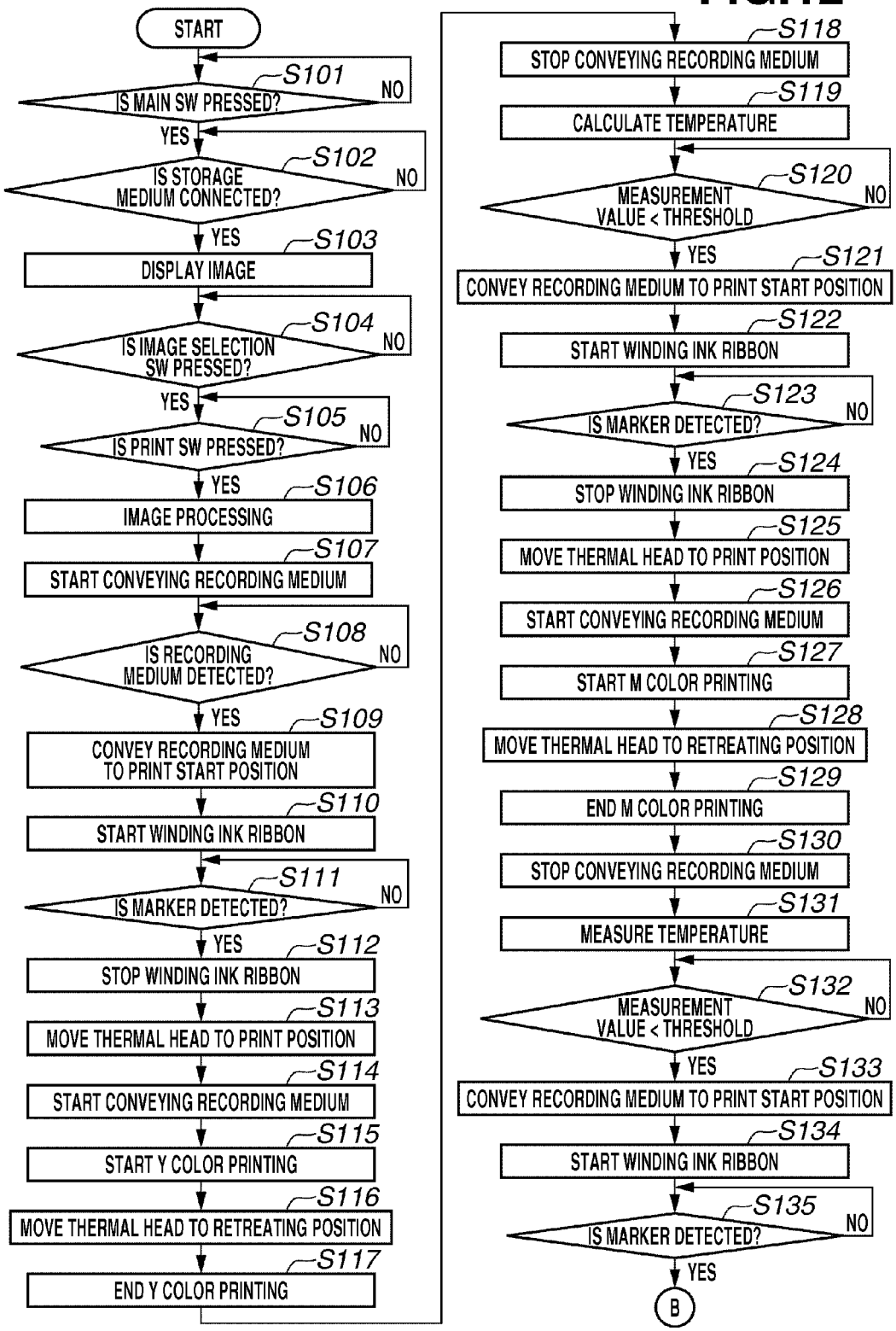
FIG. 12 is a flowchart illustrating an operating procedure of a printer according to a second exemplary embodiment of the present invention.
Figure 13:
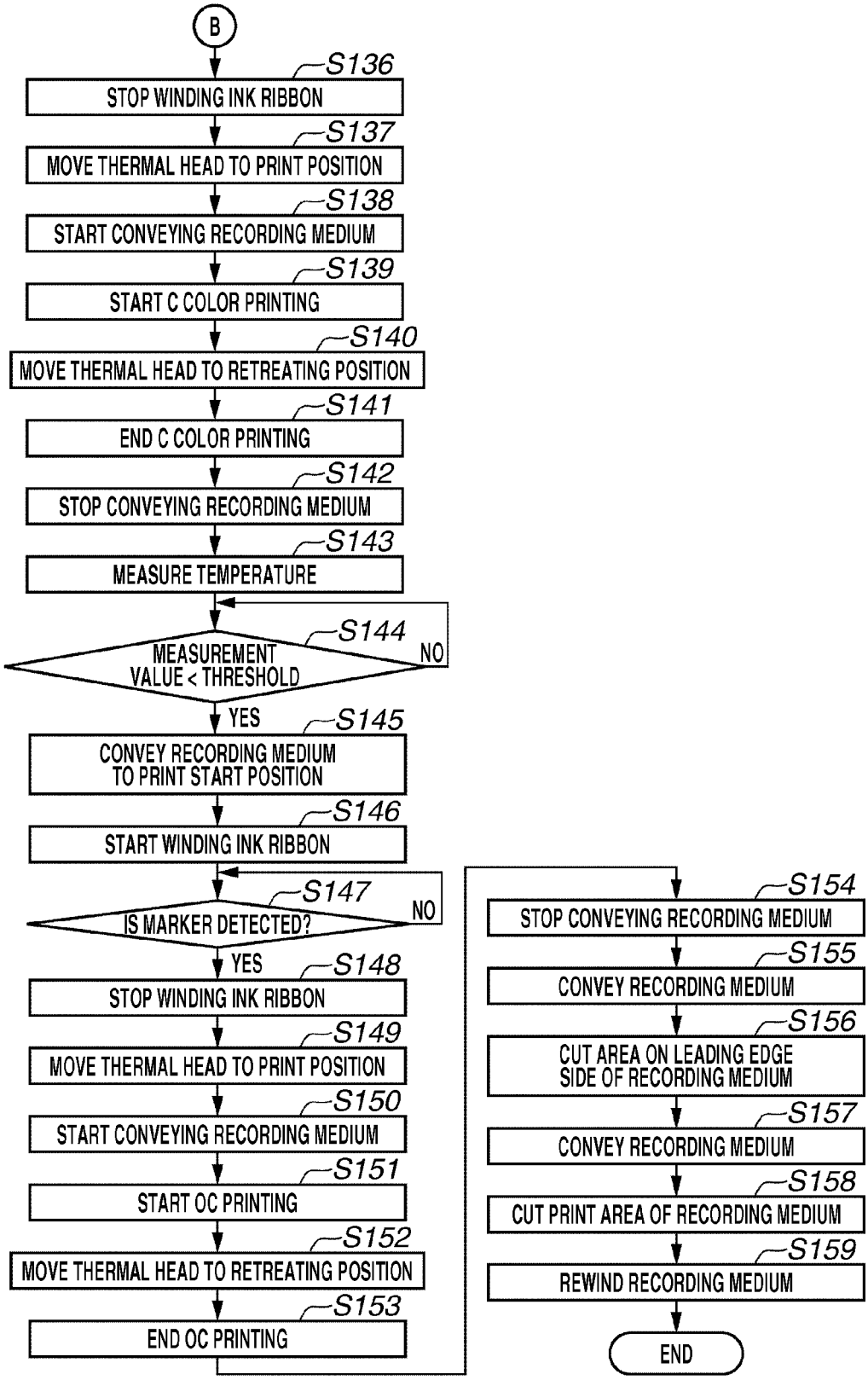
FIG. 13 is a flowchart illustrating another operating procedure of the printer according to the second exemplary embodiment.
Figure 14A:
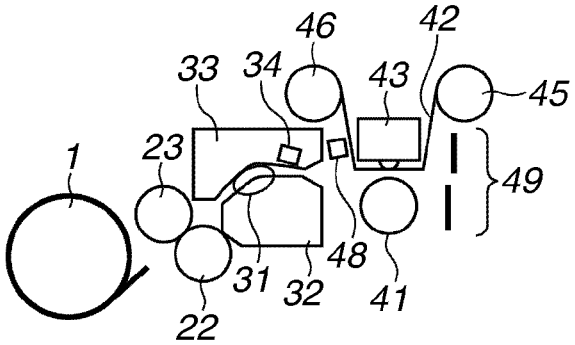
FIGS. 14A to 14D illustrate conveyance states of a recording medium in Y color printing operation according to the second exemplary embodiment.
Figure 14B:
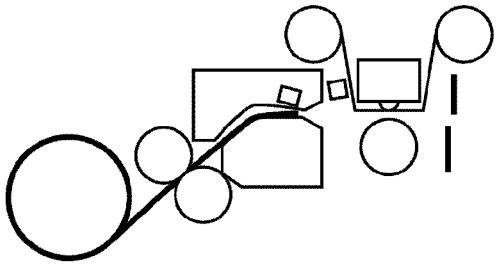
Figure 14C:
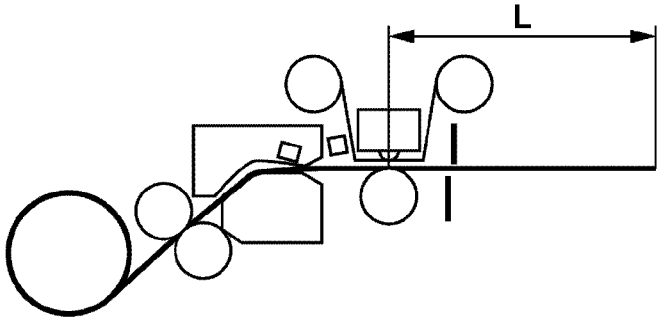
Figure 14D:
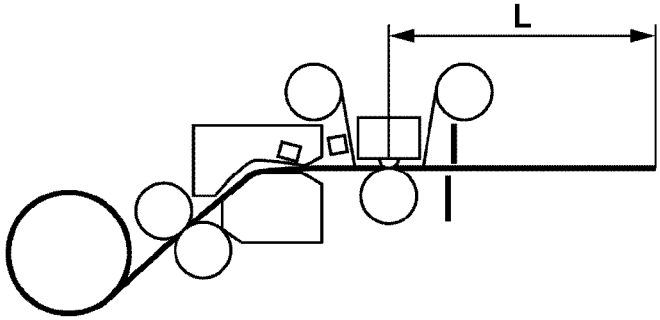

FIGS. 12 and 13 are flowcharts illustrating operating procedures of the printer according to the second exemplary embodiment.

Referring to FIG. 12, the operation in steps S101 to S108 is similar to that in steps S1 to S8 and is not specifically described.

FIGS. 14A to 14D illustrate conveyance states of the recording medium 1 in the Y color printing operation according to the second exemplary embodiment.

The operation in step S108 ends. Steps S109 to S118 are executed as the Y color printing operation. The operation in steps S109 to S118 is similar to that in steps S9 to S18. Referring to FIGS. 14A to 14D, the operation of the conveyance unit 2 under the control of the control unit 5 causes the recording medium 1 to pass through the decurling unit 3, the conveyance unit 2 conveys the recording medium 1 to the print start position at which a length from the leading edge to the platen roller 41 is L, and the Y color printing operation is executed.

The conveyance of the recording medium 1 stops in step S118. In step S119, the control unit 5 measures the temperature of the thermal head 43 from the detection value of the temperature sensor 79. In step S120, the control unit 5 checks whether the measurement value is lower than a predetermined threshold. Until the measurement value becomes lower than the threshold, the recording medium 1 is in the standby mode. When the measurement value becomes lower than the threshold, the M color printing operation is executed.

FIGS. 15A to 15D illustrate conveyance states of the recording medium 1 in the M color printing operation, the C color printing operation, and the OC printing operation according to the second exemplary embodiment.

Figure 15A:
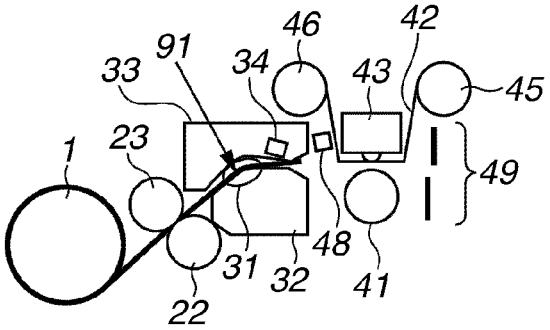
FIGS. 15A to 15D illustrate conveyance states of the recording medium in M color printing operation, C color printing operation, and OC printing operation according to the second exemplary embodiment.
Figure 15B:
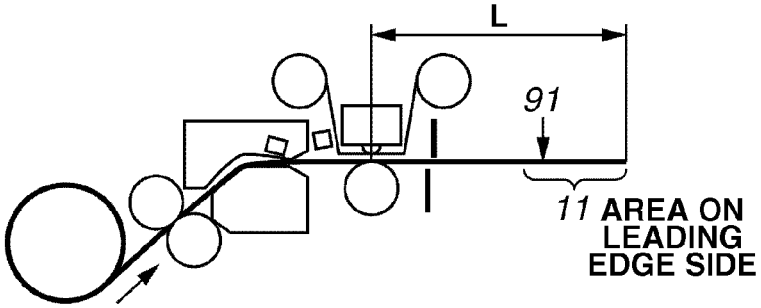
Figure 15C:
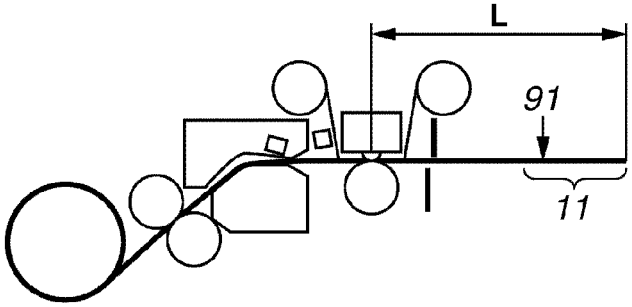
Figure 15D:
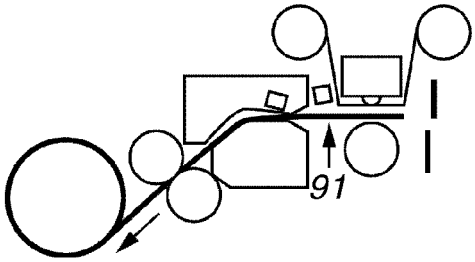

After ending the Y color printing operation, the recording medium 1 is in the standby mode in contact with the raised portion 31 at the waiting position 91 set within the area 11 on the leading edge side (refer to FIGS. 15A and 15B). When the recording medium 1 is in the standby mode as illustrated in FIG. 15A, if the measurement value of the control unit 5 is lower than the threshold, the operation in steps S121 to S130 is executed. The operation in steps S121 to 130 is similar to that in steps S109 to S118. More specifically, after conveying the recording medium 1 to the same print start position as that of the Y color printing operation, the recording medium 1 is returned toward the decurling unit 3 and the M color ink is simultaneously attached to the recording medium 1 (refer to FIGS. 15B to 15D). In step S130, the waiting position 91 is set as the contact position of the recording medium 1 with the raised portion 31, at the end time of conveyance in the M color printing operation, similar to the end time of the Y color printing operation.

In step S130, the conveyance of the recording medium 1 stops. In step S131, the control unit 5 measures the temperature of the thermal head 43 from the detected value of the temperature sensor 79. In step S132, the control unit 5 checks whether the measurement value is lower than a predetermined threshold. Until the measurement value becomes lower than the threshold, the recording medium 1 is in the standby mode. When the measurement value becomes lower than the threshold, steps S133 to S142 are executed as the C color printing operation.

The operation insteps S133 to S142 is similar to that in steps S109 to S118. After conveying the recording medium 1 to the same print start position as those of the Y color printing operation and the M color printing operation, the recording medium 1 is returned toward the decurling unit 3 and the C color ink is simultaneously attached to the recording medium 1 (refer to FIGS. 15A to 15D). In step S142, the waiting position 91 is set as the contact position of the recording medium 1 with the raised portion 31, at the end time of conveyance in the C color printing operation, similar to that at the end time of the Y color printing operation and the M color printing operation. A flowchart subsequent to step S136 is illustrated in FIG. 13.

In step S142, the conveyance of the recording medium 1 stops. In step S143, the control unit 5 measures the temperature of the thermal head 43 from the detected value of the temperature sensor 79. In step S144, the control unit 5 checks whether the measurement value becomes lower than a predetermined threshold. Until the measurement value becomes lower than the threshold, the recording medium 1 is in the standby mode. When the measurement value becomes lower than the threshold, steps S145 to S154 are executed as the OC printing operation.

The operation insteps S145 to S154 is similar to that in steps S109 to S118. After conveying the recording medium 1 to the same print start position as the printing with the colors, the recording medium 1 is returned toward the decurling unit 3 and the OC ink is simultaneously attached to the recording medium 1 (refer to FIGS. 15A to 15D). In step S154, the waiting position 91 is set as the contact position of the recording medium 1 with the raised portion 31, at the end time of conveyance in the OC printing operation, similar to that at the end time of the printing operation with the colors. After ending the OC printing operation, the cutting operation is executed.

FIGS. 16A to 18E illustrate conveyance states of the recording medium 1 in the cutting operation according to the second exemplary embodiment.

Figure 16A:
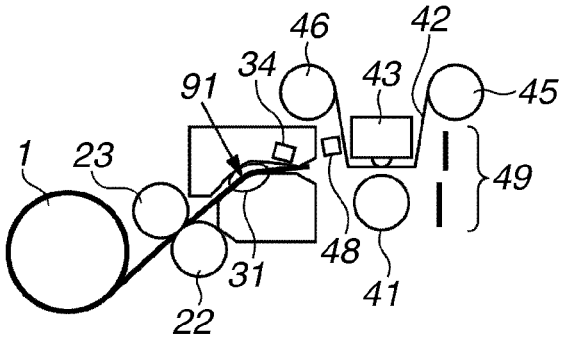
FIGS. 16A to 16E illustrate conveyance states of the recording medium in cutting operation according to the second exemplary embodiment.
Figure 16B:
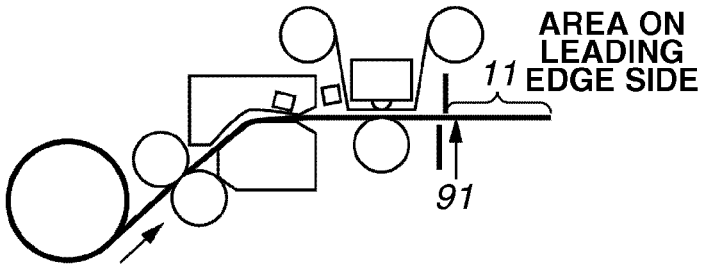
Figure 16C:
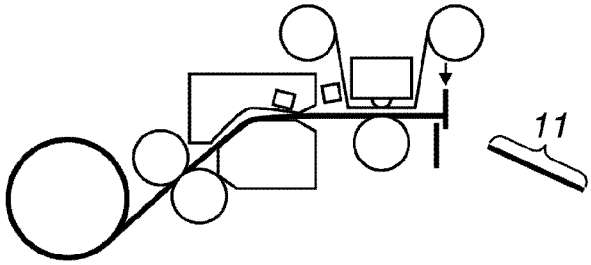
Figure 16D:
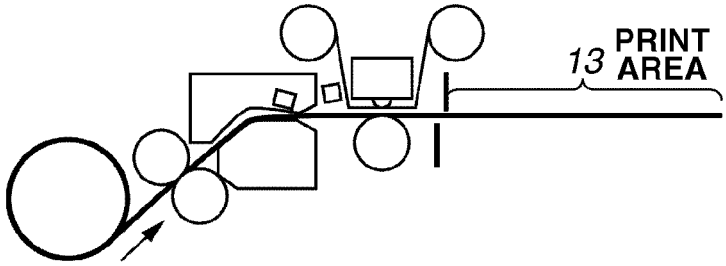
Figure 16E:
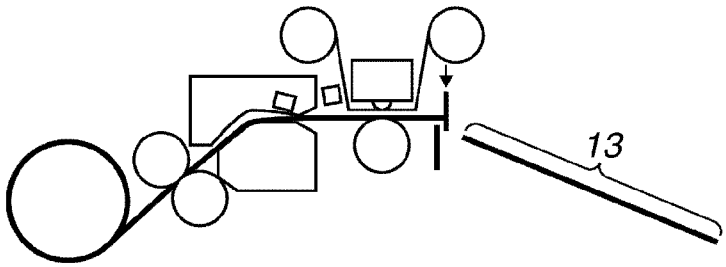

After the OC printing operation, the recording medium 1 is in the standby mode in contact with the raised portion 31 at the waiting position 91 (refer to FIG. 16A). In step S155, the control unit 5 conveys the recording medium 1 so that based on the control information, a length from the leading edge of the recording medium 1 to the cutter 49 becomes λ1. As a consequence, only the area 11 on the leading edge side of the recording medium 1 passes through the cutter 49 (refer to FIG. 16B). In step S156, the control unit 5 rotates the motor 44, thereby causing the cutter 49 to cut the recording medium 1. Thus, the area 11 on the leading edge side is cut (refer to FIG. 16C). In step S157, the control unit 5 conveys the recording medium 1 to the passage position of the recording medium 1 through the cutter 49 by a length (L-λ1). The passage portion through the cutter 49 in step S157 is the print area 13 (refer to FIG. 16D). The print area 13 is not in contact with the raised portion 31 in the standby mode of the recording medium 1, and the influence from the deterioration in print quality due to the decurling is therefore small. In step S158, the control unit 5 rotates the motor 44 subsequent to step S157, thereby causing the cutter 49 to cut the recording medium 1. Thus, the print area 13 is cut (refer to FIG. 16E). In step S159, the control unit 5 inversely rotates the motor 25, thereby rewinding the recording medium 1 with the core portion 21 and the grip roller 22. Then, the cutting operation ends.

According to the second exemplary embodiment, the waiting positions after the individual printing operation are identical within the area 11 on the leading edge side, thereby simplifying the conveyance control of the recording medium 1 as compared with the first exemplary embodiment. The waiting positions are identical, and the area 11 on the leading edge side that may deteriorate the print quality is thus cut from the print area 13, so that only a portion with no deterioration in print quality is printed out.

A configuration of a printer according to a third exemplary embodiment is similar to that of the printer 100 according to the first exemplary embodiment. The operation of the printer is described below.

Figure 17:
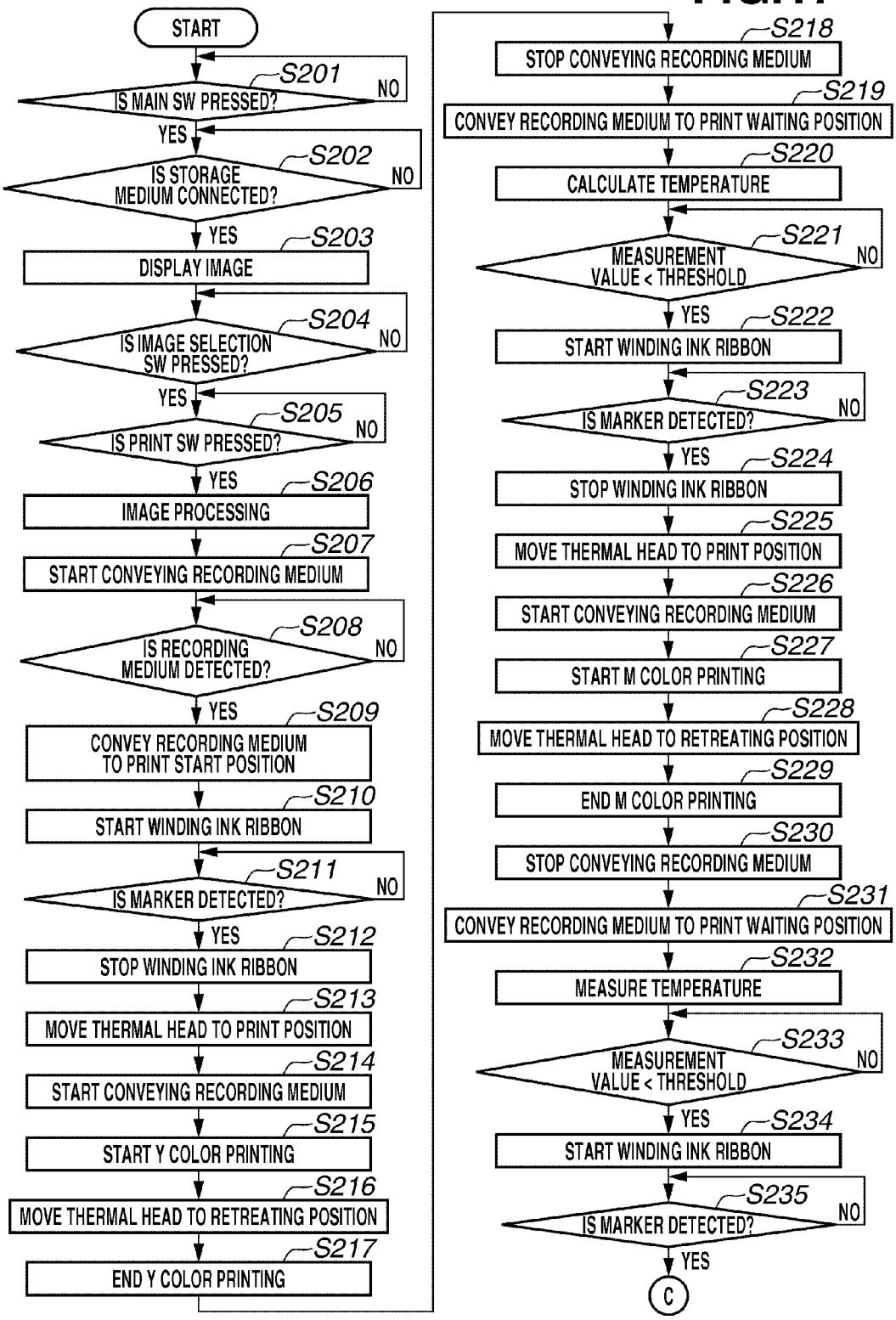
FIG. 17 is a flowchart illustrating an operating procedure of a printer according to a third exemplary embodiment of the present invention.
Figure 18:
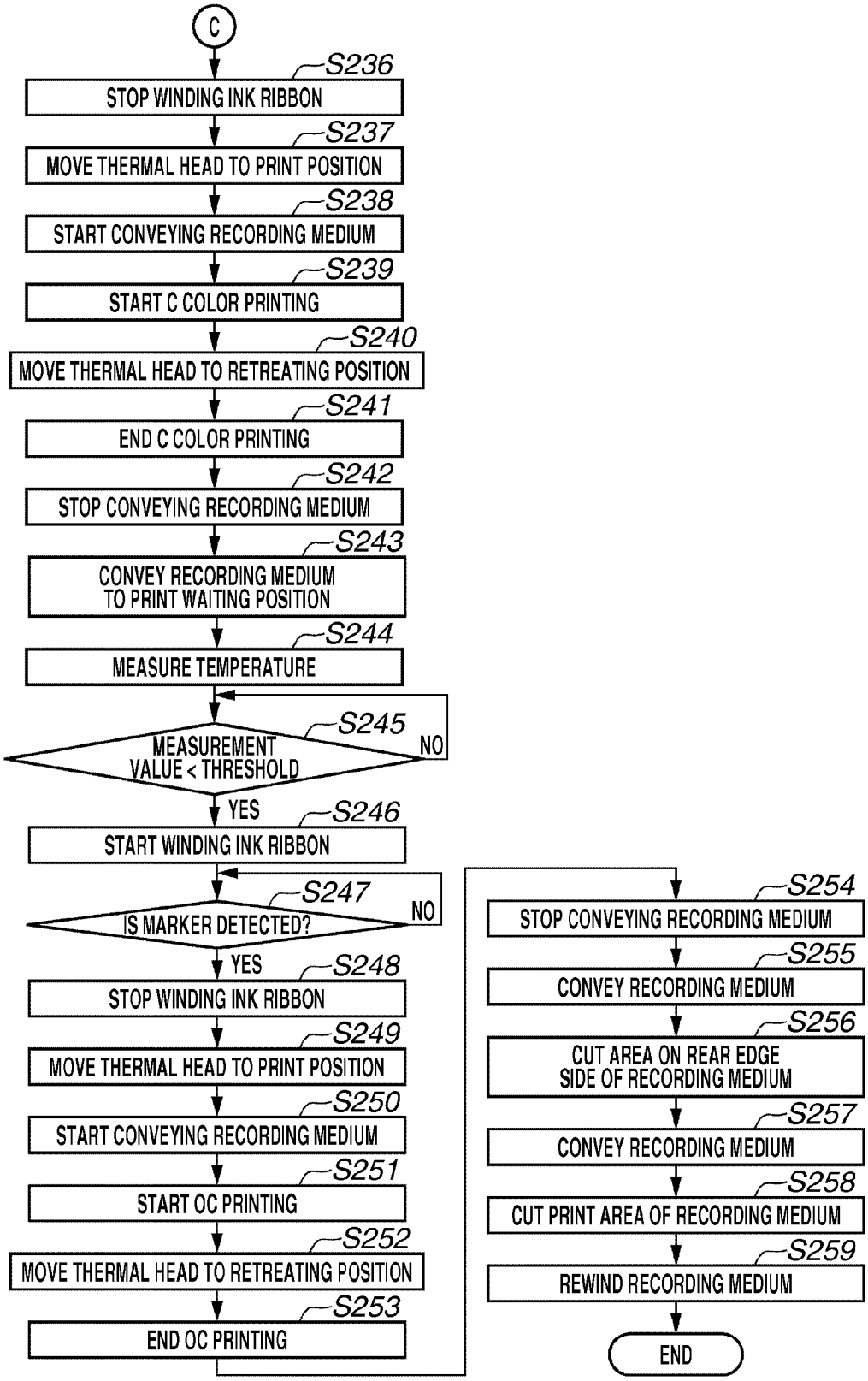
FIG. 18 is a flowchart illustrating another operating procedure of the printer according to the third exemplary embodiment.

FIGS. 17 and 18 are flowcharts illustrating operating procedures of the printer according to the second exemplary embodiment.

Referring to FIG. 17, the operation in steps S201 to S208 is similar to that in steps S1 to S8 and is not described in detail.

FIGS. 19A to 19D illustrate conveyance states of the recording medium 1 in the Y color printing operation according to the third exemplary embodiment.

Figure 19A:
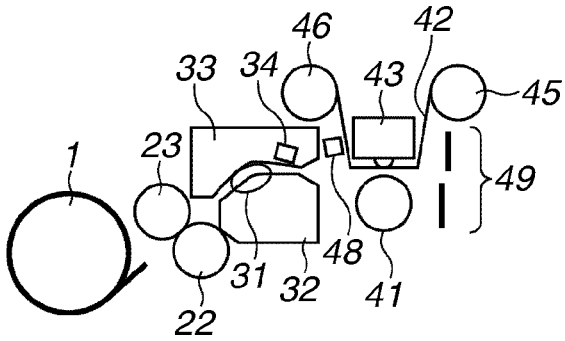
FIGS. 19A to 19D illustrate conveyance states of a recording medium in Y color printing operation according to the third exemplary embodiment.
Figure 19B:
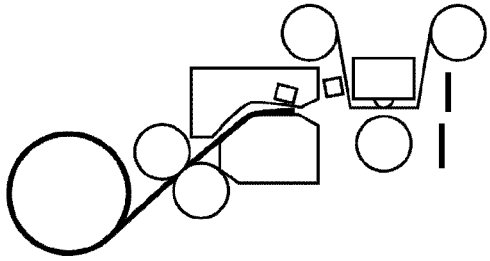
Figure 19C:
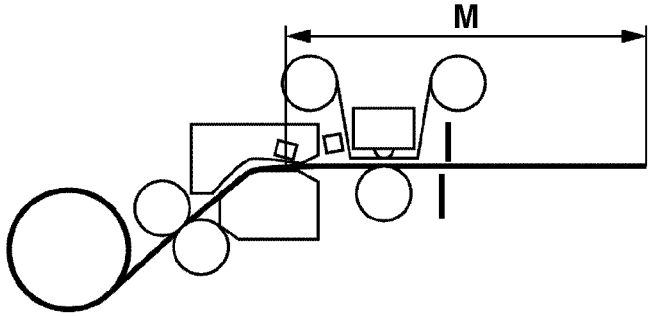
Figure 19D:
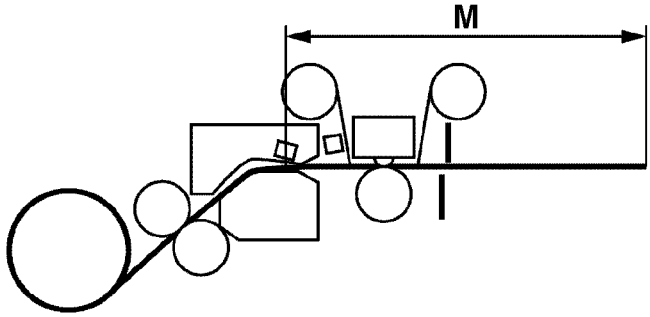
Figure 20A:
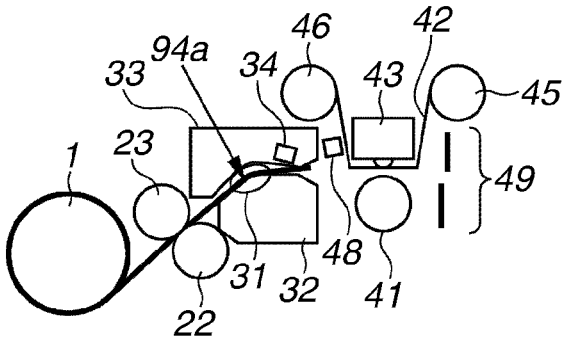
FIGS. 20A to 20D illustrate conveyance states of the recording medium in M color printing operation according to the third exemplary embodiment.
Figure 20B:
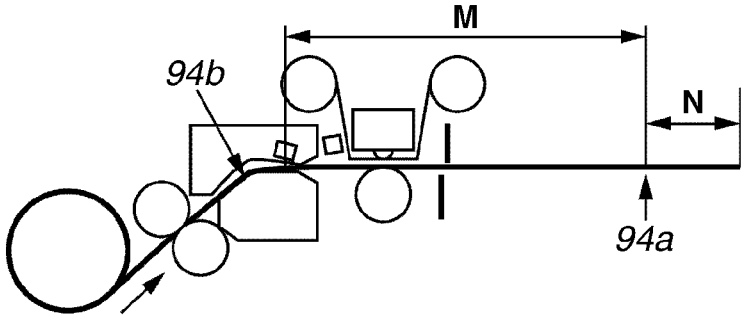
Figure 20C:
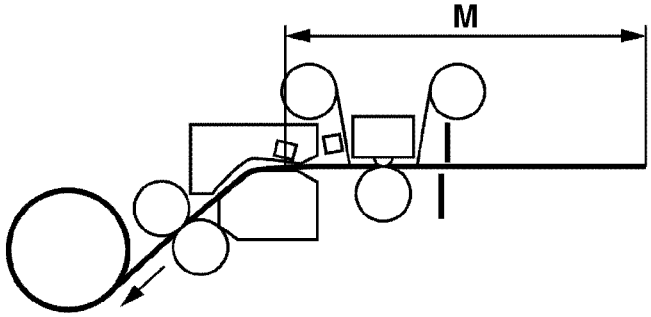
Figure 20D:
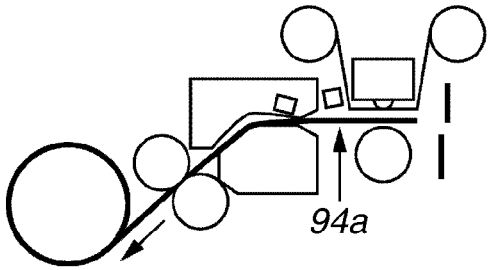

When the operation in step S208 ends, the Y color printing operation is executed in steps S209 to S218. The operation in steps S209 to S218 is similar to that in steps S9 to S18. Referring to FIGS. 19A to 19D, after conveying the recording medium 1 to the print start position, the Y color printing operation is executed while returning the recording medium 1 toward the decurling unit 3 according to the second exemplary embodiment. In step S209, the print start position is located where a length from the leading edge of the recording medium 1 to the recording medium detection sensor 34 is M, as illustrated in FIGS. 19C and 19D.

FIGS. 20A to 20D illustrate conveyance states of the recording medium 1 in the M color printing operation according to the third exemplary embodiment. After ending the Y color printing operation, the recording medium 1 is in the standby mode in contact with the raised portion 31 at a waiting position 94*a* (refer to FIG. 20A). In step S219, the control unit 5 conveys the recording medium 1 to the print waiting position of the M color printing operation after a predetermined time has elapsed. Specifically, the control unit 5 rotates the motor 25 based on the control information, thereby pulling out the recording medium 1 from the decurling unit 3 by a length obtained by adding a length N from the leading edge of the recording medium 1 to the waiting position 94*a*, to the length M (refer to FIG. 20B). In step S220, the control unit 5 measures the temperature of the thermal head 43 from the detected value of the temperature sensor 79. In step S221, the control unit 5 checks whether the measurement value becomes lower than a predetermined threshold. Until the measurement value becomes lower than the threshold, the recording medium 1 is in the standby mode. When the measurement value becomes lower than the threshold, the control unit 5 is in the standby mode while the waiting position 94*b* is in contact with the raised portion 31.

When the measurement value of the control unit 5 becomes lower than the threshold, the M color printing operation is executed in steps S222 to S230. The operation in steps S222 to S230 is similar to that in steps S210 to S218. In step S227, the control unit 5 adjusts the print start position of the M color printing operation to be similar to that of the Y color printing operation based on the control information with the conveyance unit 2, and thereafter heats the thermal head 43. More specifically, when the length from the leading edge of the recording medium 1 to the recording medium detection sensor 34 becomes M, the control unit 5 heats the thermal head 43 (refer to FIG. 20C). After the attachment of the M color ink ends, the recording medium 1 is returned toward the decurling unit 3 (refer to FIG. 20D).

FIGS. 21A to 21D illustrate conveyance states of the recording medium 1 in the C color printing operation according to the third exemplary embodiment.

Figure 21A:
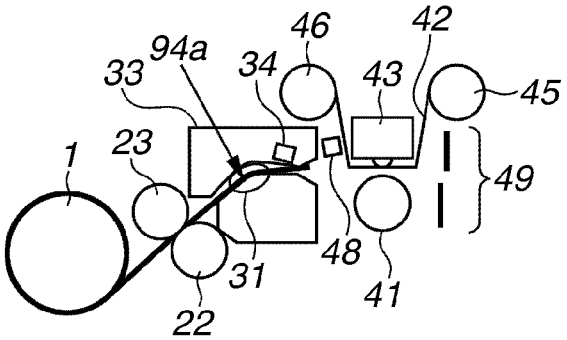
FIGS. 21A to 21D illustrate conveyance states of the recording medium in C color printing operation according to the third exemplary embodiment.
Figure 21B:
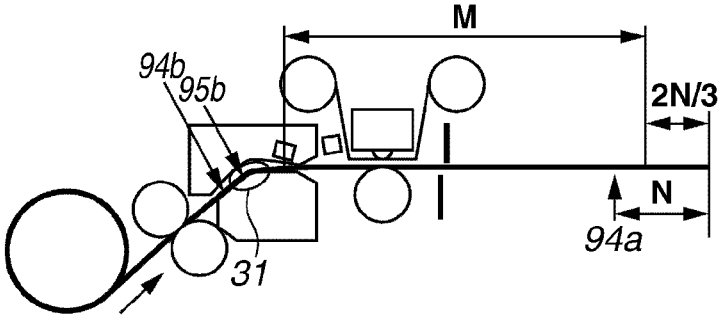
Figure 21C:
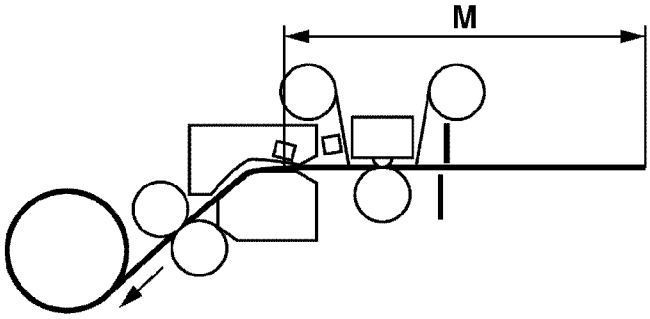
Figure 21D:
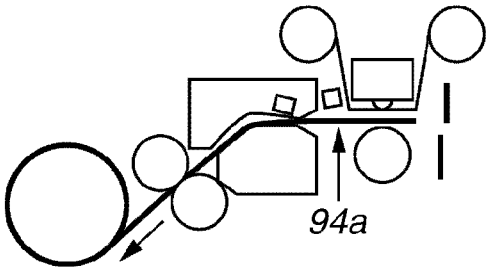

After ending the M color printing operation, the recording medium 1 is in the standby mode in contact with the raised portion 31 at the waiting position 94*a* (refer to FIG. 21A). In step S231, the control unit 5 conveys the recording medium 1 to the print waiting position of the C color printing operation after a predetermined time has elapsed. Specifically, the control unit 5 rotates the motor 25 based on the control information, thereby pulling out the recording medium 1 from the decurling unit 3 by a length obtained by adding a length 2N/3 to the length M (refer to FIG. 21B). As a result of the operation, the contact position of the recording medium 1 with the raised portion 31 becomes a waiting position 95*b*, which is nearer to the leading edge of the recording medium 1 than the waiting position 94*b*. In step S232, the control unit 5 measures the temperature of the thermal head 43 from the detected value of the temperature sensor 79. In step S233, the control unit 5 checks whether the measurement value is lower than a predetermined threshold. Until the measurement value becomes lower than the threshold, the recording medium 1 is in the standby mode, being in a state in which the waiting position 95*b* is in contact with the raised portion 31.

When the measurement value of the control unit 5 becomes lower than the threshold, the C color printing is executed in the operation insteps S234 to S242. The operation in steps S234 to S242 is similar to the operation in steps S210 to S218. A flowchart subsequent to step S236 is illustrated in FIG. 18. In step S239, the control unit 5 adjusts the print start position in the C color printing operation to be similar to those of the Y color printing operation and the M color printing operation based on the control information with the conveyance unit 2, and thereafter heats the thermal head 43. More specifically, when the length from the leading edge of the recording medium 1 to the recording medium detection sensor 34 becomes M, the control unit 5 heats the thermal head 43 (refer to FIG. 21C). After the attachment of the C color ink ends, the recording medium 1 is returned toward the decurling unit 3 (refer to FIG. 21D).

FIGS. 22A to 22D illustrate conveyance states of the recording medium 1 in the OC printing operation according to the third exemplary embodiment.

Figure 22A:
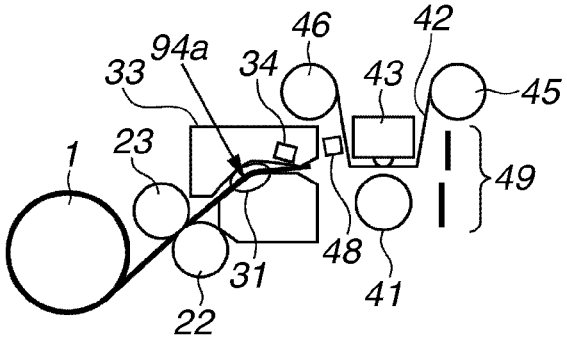
FIGS. 22A to 22D illustrate conveyance states of the recording medium in OC printing operation according to the third exemplary embodiment.
Figure 22B:
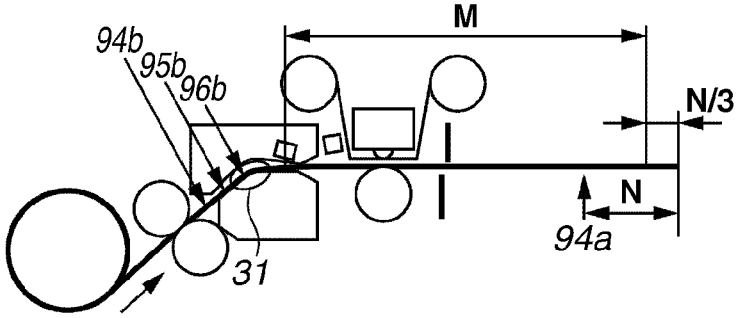
Figure 22C:
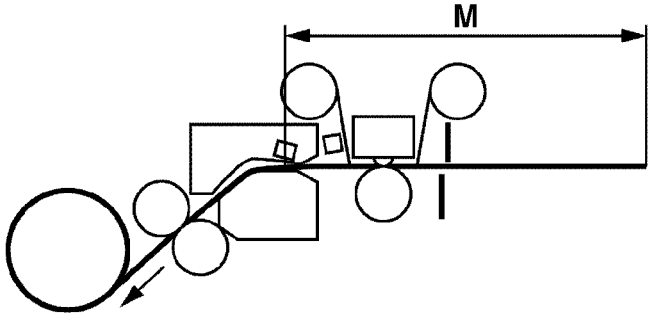
Figure 22D:
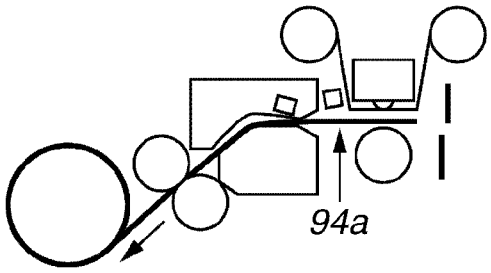

After the C color printing operation ends, the recording medium 1 is in the standby mode in contact with the raised portion 31 at the waiting position 94*a* (refer to FIG. 22A). In step S243, the control unit 5 conveys the recording medium 1 to the print waiting position of the OC color printing operation after a predetermined time has elapsed. Specifically, the control unit 5 rotates the motor 25 based on the control information, thereby pulling out the recording medium 1 from the decurling unit 3 by a length obtained by adding a length N/3 to the length M (refer to FIG. 22B). As a result of the operation, the contact position of the recording medium 1 with the raised portion 31 becomes a waiting position 96*b*, which is nearer to the leading edge of the recording medium 1 than the waiting position 95*b*. In step S244, the control unit 5 measures the temperature of the thermal head 43 from the detected value of the temperature sensor 79. In step S245, the control unit 5 checks whether the measurement value is lower than a predetermined threshold. Until the measurement value becomes lower than the threshold, the recording medium 1 is in the standby mode, being in a state in which the waiting position 96 is in contact with the raised portion 31.

When the measurement value of the control unit 5 becomes lower than the threshold, the OC printing operation is executed in steps S246 to S254. The operation in steps S246 to S254 is similar to that in steps S210 to 218. In step S251, the control unit 5 adjusts the print start position of the OC printing operation to be similar to those of the printing with the colors based on the control information with the conveyance unit 2, and thereafter heats the thermal head 43. More specifically, when the length from the leading edge of the recording medium 1 to the recording medium detection sensor 34 becomes M, the control unit 5 heats the thermal head 43 (refer to FIG. 22C). After the attachment of the OC ink ends, the recording medium 1 is returned toward the decurling unit 3 (refer to FIG. 22D). The cutting operation is subsequently executed.

FIGS. 23A to 23E illustrate conveyance states of the recording medium 1 in the cutting operation according to the third exemplary embodiment.

Figure 23A:
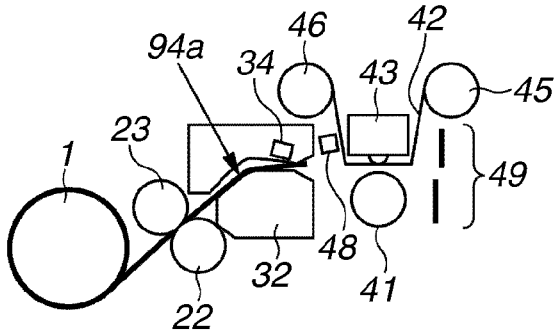
FIGS. 23A to 23E illustrate conveyance states of the recording medium in cutting operation according to the third exemplary embodiment.
Figure 23B:
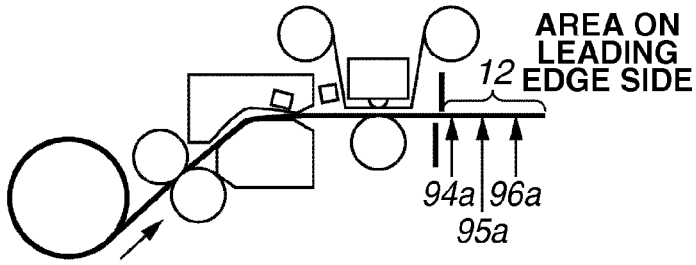
Figure 23C:
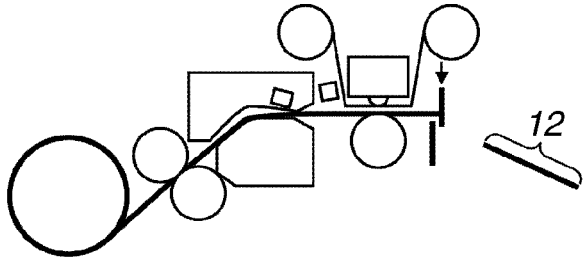

After the OC printing operation ends, the recording medium 1 is in the standby mode, being in contact with the raised portion 31 at the waiting position 94*a* (refer to FIG. 23A). In step S255, the control unit 5 conveys the recording medium 1 so that based on the control information, a length from the leading edge of the recording medium 1 to the cutter 49 is λ2, as illustrated in FIG. 23B. In step S256, the control unit 5 rotates the motor 44, thereby causing the cutter 49 to cut the recording medium 1 as illustrated in FIG. 23C. The cutting portion in step S256 is an area 12 on the rear edge side of the printing target range of the recording medium 1 corresponding to the previous printing operation. In other words, at the waiting positions 94*a*, 95*a*, and 96*a* in FIG. 23B, the recording medium 1 is in contact with the raised portion 31 in the standby mode thereof in the previous printing operation.

Figure 23D:
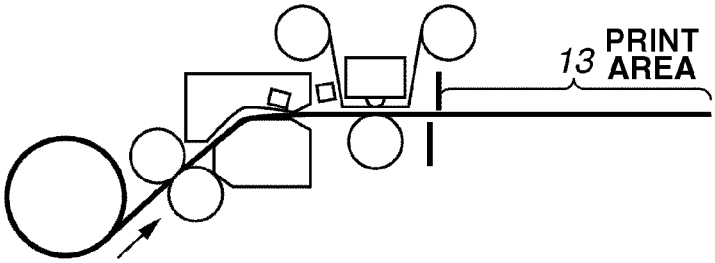
Figure 23E:
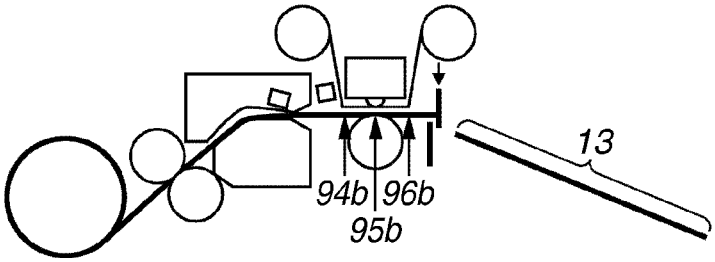

Subsequent to step S255, in step S257, the control unit 5 conveys the recording medium 1 so that only the print area 13 passes through the cutter 49 based on the control information, as illustrated in FIG. 23D. In step S258, the control unit 5 rotates the motor 44, thereby causing the cutter 49 to cut the recording medium 1. Thus, the print area 13 is cut from the area 12 on the rear end side set as the waiting position when the ink is attached to the print area 13 (refer to FIG. 23E). In step S259, the control unit 5 rotates the motor 25, thereby rewinding the recording medium 1 with the core portion 21 and the grip roller 22. Then, the cutting operation ends.

According to the third exemplary embodiment, the recording medium 1 waits with the decurling unit 3 each time the printing with one color ends. At this time, the waiting position is set within the area 12 on the rear edge side where the influence on the print quality is a relatively small in the printing target range. Thus, the deterioration in print quality is prevented without adding a new mechanism such as a mechanism for resetting the decurling.

According to the third exemplary embodiment, the waiting positions are differently set within the area 12 on the rear edge side, thereby preventing the concentration of the decurling of the raised portion 31 at the same position in the area 12 on the rear edge side. As a consequence, the crease is certainly prevented in the area 12 on the rear edge side. The later the ink is attached, the nearer the waiting positions are set to the leading edge of the printing target range of the recording medium 1 according to the third exemplary embodiment. As a consequence, the smaller the number of print colors, the higher the decurling effect and, the larger the number of print colors, the lower the decurling effect. Even if the heating time of the recording medium is prolonged together with the increase in print colors, the creation of crease is suppressed.

Figure 24:
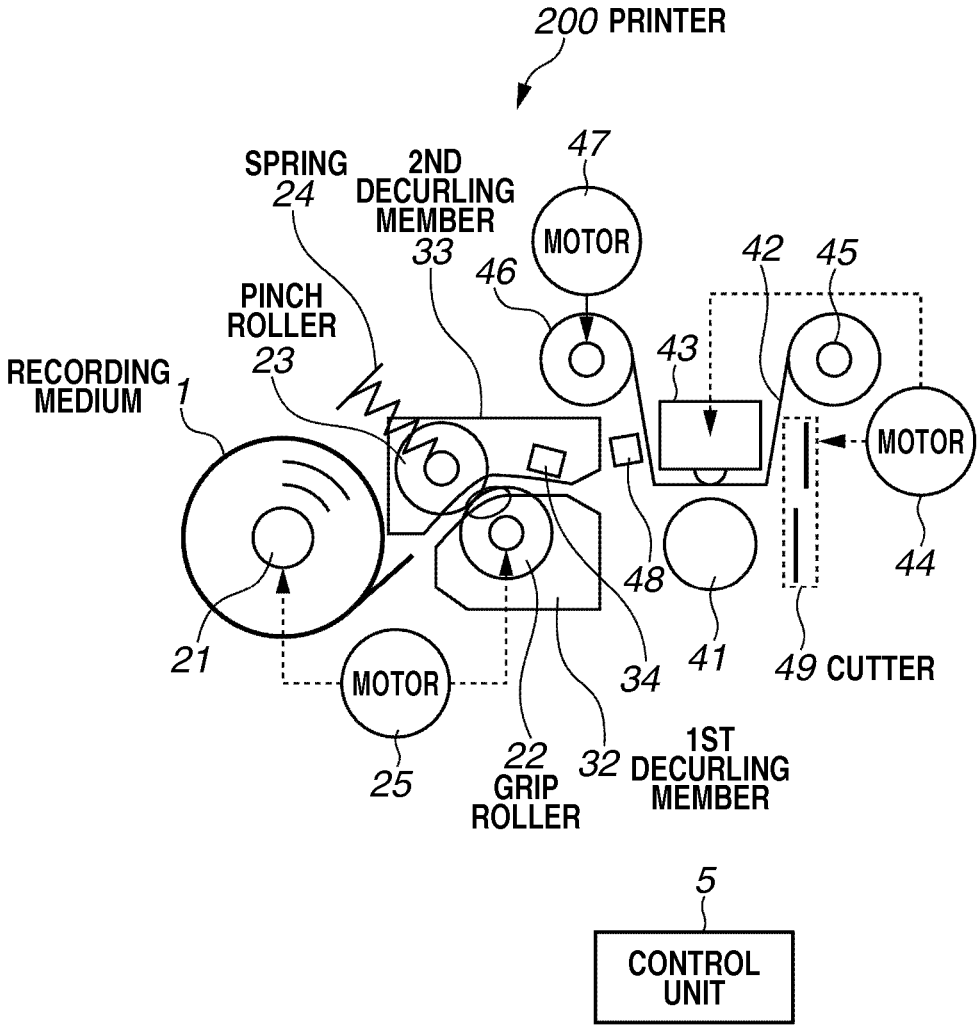
FIG. 24 illustrates a configuration of a printer according to a fourth exemplary embodiment of the present invention.

FIG. 24 illustrates a configuration of a printer according to a fourth exemplary embodiment. The same reference numerals denote the same components as those in the printer 100 according to the first exemplary embodiment, and are not described in detail.

Referring to FIG. 24, in a printer 200 according to the fourth exemplary embodiment, the grip roller 22 is disposed in the first decurling member 32. The pinch roller 23 is arranged, facing the grip roller 22 in the second decurling member 33. The printer 200 executes any of the operations according to the first to third exemplary embodiments. When executing the printing operation according to the first exemplary embodiment, at the waiting position after the OC printing operation, the recording medium 1 remains nipped between the grip roller 22 and the pinch roller 23.

According to the fourth exemplary embodiment, the grip roller 22 functions as the raised portion 31 to decurl the recording medium 1 with a cylindrical surface of the grip roller 22. Consequently, the grip roller 22 is housed within the decurling unit 3 and the scale of apparatus is reduced. Regarding conveyance resistance of the recording medium 1, the rotatable grip roller 22 is smaller than the raised portion 31. Hence, the recording medium 1 is smoothly conveyed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-231451 filed Oct. 5, 2009, which is hereby incorporated by reference herein in its entirety.

What is claimed is:

1. A printer that divides a roll recording medium in a length direction to set one printing target range, the printer comprising:

a conveyance unit configured to nip and simultaneously convey the roll recording medium;

a print unit configured to print an image by sequentially transferring a plurality of color inks on the recording medium while nipping the recording medium conveyed by the conveyance unit;

a decurling unit disposed between the conveyance unit and the print unit, and configured to include a raised portion that decurls the recording medium by contacting the recording medium conveyed by the conveyance unit; and a control unit configured to control the conveyance unit to convey the recording medium to a waiting position after ending the transfer of one color ink, wherein the waiting position is a position where an area on a leading edge side of the recording medium is in contact with the raised portion, and wherein the waiting position is different within the area on the leading edge side for each of the color inks.

2. The printer according to claim 1, wherein the waiting position is set so that the later the ink is attached to the recording medium, the nearer the waiting position is located to an end portion of the printing target range of the recording medium.

3. The printer according to claim 1, wherein the print unit includes a cutter configured to cut the recording medium, and the control unit controls the conveyance unit to pull out the recording medium to a position where the area on the leading edge side passes through the cutter, after ending the printing operation when the waiting position is within the area on the leading edge side, and then controls the cutter to cut the area on the leading edge side.

4. The printer according to claim 1, wherein:

the print unit includes a cutter configured to cut the recording medium, the area on the leading edge side of the recording medium is an area on a rear edge side of the printing target range of a previous printing operation, and the control unit controls the conveyance unit to pull out the recording medium to a position where the area on the rear edge side of the previous printing operation passes through the cutter, after ending the printing operation when the waiting position is within the area on the rear edge side, and then controls the cutter to cut the area on the rear edge side.

5. The printer according to claim 1, wherein the print unit includes a thermal head and a temperature sensor configured to detect a temperature of the thermal head, and the control unit attaches one of the plurality of color inks to the recording medium, thereafter measures the temperature of the thermal head based on a detected value of the temperature sensor and when the measurement value is lower than a threshold, controls the print unit to attach another color ink among the plurality of color inks to the recording medium.

6. The printer according to claim 1, wherein the decurling unit includes a first decurling member including the raised portion and a second decurling member disposed facing the first decurling member, and forms a conveyance passage configured to curl the recording medium in a space between a surface having the raised portion of the first decurling member and the second decurling member in the inverse direction of the curling.

7. The printer according to claim 1, wherein the area on the leading edge side of the recording medium is an area a leading edge side of a current printing operation or an area on a rear edge side of the printing target range of a previous printing operation.

* * * * *